US007310574B2

(12) United States Patent
Di Cola et al.

(10) Patent No.: US 7,310,574 B2
(45) Date of Patent: Dec. 18, 2007

(54) ELECTRONIC ARCHITECTURE OF AN AUTOMATIC SYSTEM FOR DRIVING AN INTERNAL COMBUSTION ENGINE

(75) Inventors: Eusebio Di Cola, Messina (IT); Federico Rivoli, Messina (IT); Rosario Martorana, Messina (IT); Lucio Ticli, San Giovanni la Punta (IT); Marinella Milazzo, Ragalna (IT); Mario Barone, Militello in Val di Catania (IT); Eugenio Cintolo, Ragusa (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 563 days.

(21) Appl. No.: 10/722,375

(22) Filed: Nov. 25, 2003

(65) Prior Publication Data

US 2004/0249552 A1 Dec. 9, 2004

(30) Foreign Application Priority Data

Nov. 28, 2002 (EP) ..... 02425726
Nov. 28, 2002 (EP) ..... 02425728
Nov. 28, 2002 (EP) ..... 02425731
Nov. 28, 2002 (EP) ..... 02425732

(51) Int. Cl.
*F02D 41/28* (2006.01)

(52) U.S. Cl. ..... 701/103; 701/115; 73/116

(58) Field of Classification Search ..... 701/115, 701/103, 110; 73/116, 117.2, 117.3, 118.1
See application file for complete search history.

(56) References Cited

U.S. PATENT DOCUMENTS 5,201,296 A 4/1993 Wunning et al. ..... 123/479
5,233,964 A 8/1993 Jamoua et al. ..... 123/479
5,548,995 A 8/1996 Clinton et al. ..... 73/116
5,594,646 A 1/1997 Itoh et al. ..... 364/424.04
5,794,592 A 8/1998 Fukui ..... 123/414
5,829,412 A 11/1998 Klatt et al. ..... 123/500
5,860,406 A 1/1999 Schmidt et al. ..... 123/501
6,109,224 A 8/2000 Morikawa et al. ..... 123/90.15
6,494,086 B1 * 12/2002 Ponti ..... 73/116

FOREIGN PATENT DOCUMENTS

DE 41 00 751 A1 7/1992
DE 43 13 331 A1 10/1994
DE 199 55 513 A1 5/2001
DE 100 41 448 A1 3/2002
EP 0 582 430 A1 2/1994
JP 57-101903 6/1982

* cited by examiner

*Primary Examiner*—Willis R. Wolfe
*Assistant Examiner*—Johnny H. Hoang
(74) *Attorney, Agent, or Firm*—Lisa K. Jorgenson; Dennis M. de Guzman; Seed IP Law Group PLLC

(57) ABSTRACT

An architecture of an ignition and/or injection managing system for an internal combustion engine, of the type structured to cooperate with an electronic engine control unit. Also included is an electronic device architecture for determining the operating phase of an internal combustion motor, based on an input signal issued from a sensor of a phonic wheel associated with the motor camshaft, so as to release the electronic motor control unit from monitoring the phonic wheel signal, in order to lighten its computational load, and to enable the processing of the signal issuing from a variety of the phonic wheels. The device has the task of calculating the angular position of the drive shaft by analyzing the signal transmitted by the tone wheel of the drive shaft. A module is provided that is capable of emitting an interrupt signal toward the control unit on the basis of received signals.

36 Claims, 22 Drawing Sheets

ELECTRONIC ARCHITECTURE OF AN AUTOMATIC SYSTEM FOR DRIVING AN INTERNAL COMBUSTION ENGINE

TECHNICAL FIELD

The present invention relates to a hardware architecture of a managing system for the start-up and/or injection phase in internal combustion engines.

The invention also relates to an electronic device architecture for automatically determining the operating phase of an internal combustion motor or engine, as well to an architecture of an electronic device architecture for determining the angular position of an engine shaft in internal combustion engines.

Finally, the invention relates to a hardware architecture of an automatic system for driving injector of an internal combustion engine.

In particular, but not limited to, the invention relates to devices applied on a direct injection four-stroke motor with automatic determination of the drive shaft angular position and of the motor operating phase, having an injection and/or ignition driving system of the type structured to cooperate with an engine electronic control unit (ECU) by driving the corresponding injection drivers, but the following description covering this field of application is for convenience of explanation only.

BACKGROUND OF THE INVENTION

As it is well known in this technical field, the use of electronic units for managing the injection in modern automotive engines is now usual procedure. An example of this is provided by the European Patent Application 01830645.6, to the same Applicant.

Their use has been dictated by the need to keep certain engine parameters under control so as to diminish the engine emissions, according to the close limits set by law in many of the industrialized countries.

The leading automotive companies are increasing the production of direct injection engines to comply with such restrictive laws, calling for contaminants being released to the environment in ever decreasing amounts, as well as to raise the level of their engine performance. However, these are engines need a more sophisticated and complex control system.

Recently introduced multiple-injection fuel systems, wherein the parameters to be controlled are characterized by more pressing specifications of time, make the use of a certain number of different-type sensors, whose signals are always processed by current control units, a necessity.

Thus, nowadays these units, commonly known as ECU (Electronic Control Unit), are now called upon to provide control functions of increasing complexity.

In the automotive industry it is common practice to use ECUs equipped with a TPU co-processor (Time Processor Unit) which is specifically operative to process signals coming from a sensor of a drive shaft phonic wheel and from a sensor of a camshaft phonic wheel, thereby to determine the angular position of the drive shaft and the operative phase of the engine.

A big number of parameters must be taken into consideration to carry out the injection process under control by an ECU or a TPU in the best way. This implies a great computational load, both for the ECU and for the co-processor TPU. In fact, both these units handle a large number of signals carrying different priority levels. In all cases, these signals have to be managed by software routine, activated by interrupt signals, in case of the ECU, and by the occurrence of certain events, in case of the TPU.

In either cases, a discrepancy is bound to exist between an ideal time moment for carrying out the injection and the real time when the injection is actually carried out. This will result in incomplete combustion, generating larger pollutant amounts than intended.

SUMMARY OF THE INVENTION

An embodiment of this invention provides a new hardware architecture for an ignition and/or injection managing system of internal combustion (IC) engines, which architecture should have appropriate structural and functional features so as to allow improved management of the signals coming from the different sensors of the control unit, and therefore, improved control of means provided for the engine ignition and/or injection phase.

The hardware module, which is operating in a digital logic mode, could be used as a peripheral unit to the ECU, so as to reduce its computational load.

This hardware module would have the task of:

calculating the drive shaft angular position, by analyzing the signal from a sensor of the drive shaft phonic wheel;

calculating the engine cycle phase, by analyzing the signal coming from the sensor of the camshaft phonic wheel; and actuating the injection process, which is tracking an injection profile stored inside the module.

Another embodiment of this invention provides an electronic device for automatically determining the operating phase of a motor, which device should have appropriate structural and functional features so as to enable automatic computation of such operating phase by directly analyzing the signal from the camshaft phonic wheel.

A further embodiment of this invention provides an electronic device for determining the angular position of a drive shaft in internal combustion engines, which should exhibit such structural and functional features as to allow automatic computing of the drive shaft angular position by directly analyzing the signal transmitted by the tone wheel.

Finally, another embodiment of this invention provides a new hardware architecture for an automatic driving system for injectors in internal combustion engines, which architecture should exhibit such structural and functional features as to allow a better management of the signals transmitted by the various sensors depending on the engine control unit as well as a higher control over the means in charge of the injection and/or the engine ignition step.

In this way, the ECU is released from the task of monitoring the drive shaft angle position, from calculating the engine cycle phase, and from actuating injection and/or ignition. Moreover, the ECU is released from continually monitoring the signal from the phonic wheel of the camshaft, so as to lighten the computing load on the ECU and enable the processing of signals that issue from a plurality of phonic wheels most commonly employed in the automotive field. This allows the ECU to serve a number of different motors.

The features and advantages of the architectures and devices according to the invention will be clear from the following description of an embodiment thereof, given by way of non-limiting example with reference to the accompanying drawings.

DETAILED DESCRIPTION

Figure 1A:
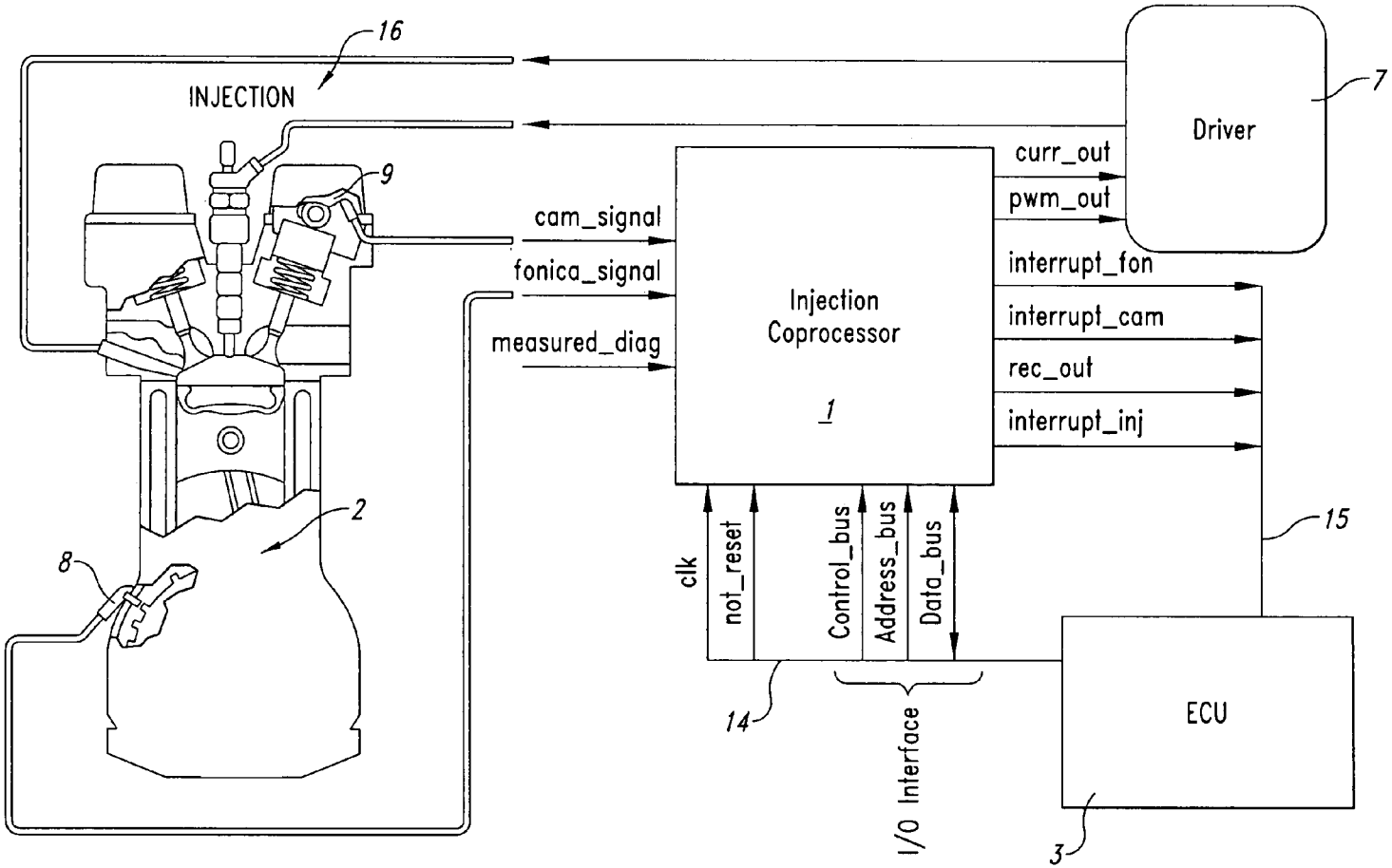
FIG. 1A shows schematically a endothermic injection engine associated with an ignition and/or injection process control unit.

With reference to FIGS. 1A to 3A, the hardware architecture of an ignition and/or injection managing system of an IC endothermic engine 2, specifically a direct-injection four-stroke cycle engine with automatic determination of a drive shaft angular position and of the cycle phase, is generally shown as a managing system 1 in FIG. 1A.

The managing system 1 is associated with an ECU 3 as conventionally used in automotive applications for controlling the ignition and/or injection in such engines. The managing system 1 is represented in FIG. 1A by a block "Injection Coprocessor" and is coupled on bus lines 14 and 15 to the ECU 3. Of course, other connections to and from the ECU 3 on various bus lines are also present.

The managing system 1 is primarily aimed at releasing the ECU 3 from monitoring the drive shaft angle position, from calculating the engine cycle phase, and from enabling the driving of the engine ignition and/or injection means 16.

The exact timing moment for actuating ignition or injection is indeed a crucial parameter, because it is responsible for the attainment of optimum combustion conditions in order to generate the smallest amount of pollutants.

The managing system 1 comprises three modules 4, 5 and 6, each one performing one of the aforementioned functions, as well as a fourth module 13 to be described. The modules 4, 5 and 6 are structurally independent, and each of them can have a respective integrated circuit allocated on a supporting board and standard bus interconnection. The engine ECU may also find place on this board.

Of course, there is no reason for the modules 4, 5, 6 and 13, and the ECU 3 not to be formed in a unique integrated circuit of the "system-on-chip" type, and still retaining their operational independence.

Figure 2A:
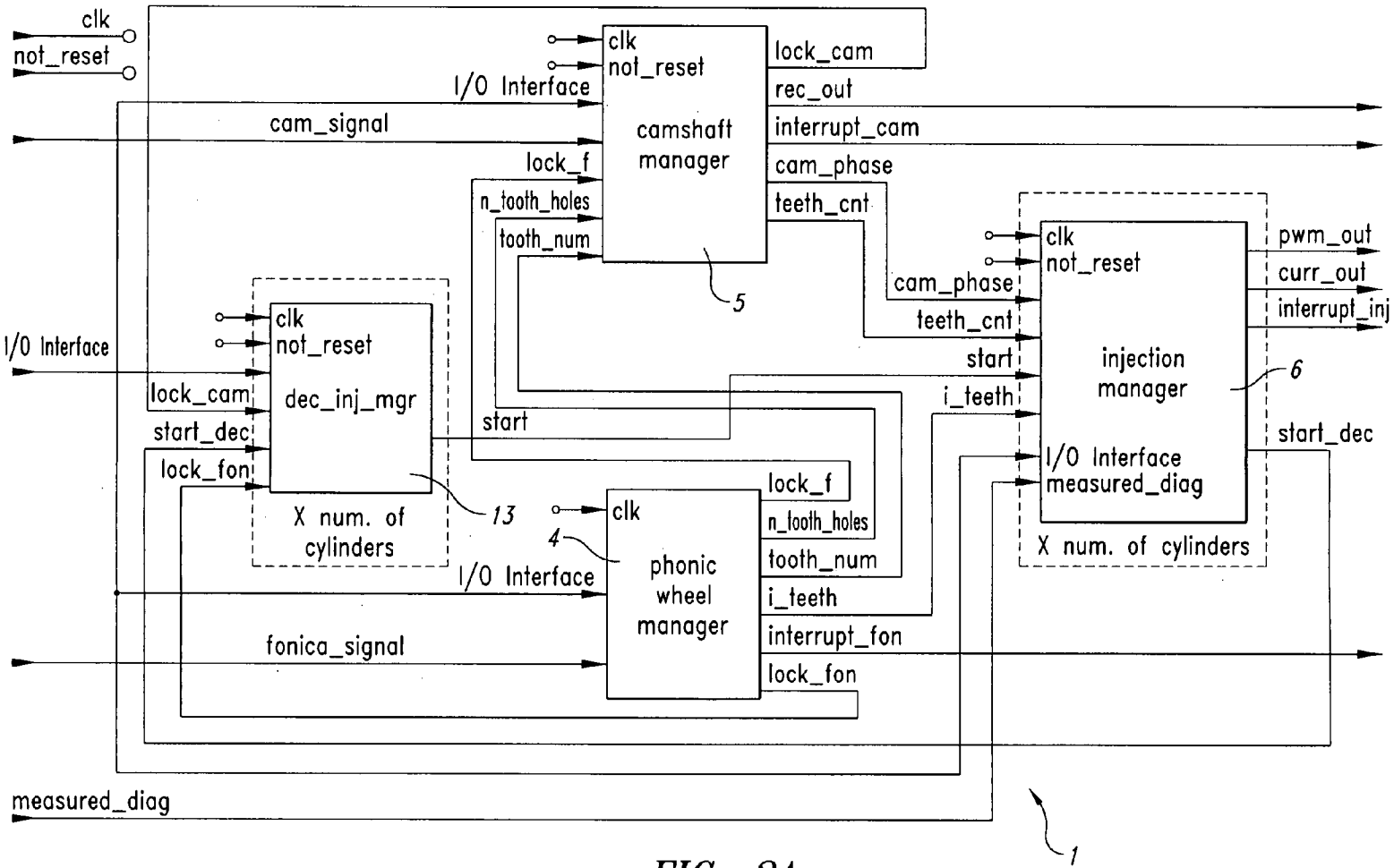
FIG. 2A is a block diagram of the managing system architecture according to the invention.

A general diagram of the hardware architecture of managing system 1 is given in FIG. 2A.

A first module 4, referred to as the "phonic wheel manager" hereinafter, has the task of processing electric signals by means of which it is possible to determine the drive shaft angle position.

This module 4 is input a signal from a phonic wheel sensor 8, the phonic wheel being rotatively rigid with the drive shaft. The phonic wheels are formed with a predetermined number n of equidistant teeth allocated on the circumference. A small group of m adjoining teeth is omitted to define a reference point on the wheel. The sensor 8 generates a signal, from which module 4 looks for the reference point and issues a signal when it finds the reference point and another signal indicating how many teeth have been passing after the reference point.

A second module 5, referred to as the "camshaft manager" hereinafter, has the task of processing electric signals that allows the cycle phase of the engine to be determined.

The phases of a four-stroke engine can be identified through the movement of the piston in its cylinder and through the position of the valves managed by the camshaft. The four phases are: induction, compression, combustion/expansion, and exhaust. The movement of the piston toward the engine head takes place both with all the valves closed (compression phase) and with the exhaust valve open (exhaust phase). The piston will then move in the opposite direction either with both valves closed (combustion/expansion phase) or with the induction valve open (induction phase).

Two revolutions of the drive shaft correspond to the four engine phases and to one camshaft revolution. Thus, the rotation ratio between the camshaft and the drive shaft is 1:2. The timing period for the injection to take place is between a compression phase and the next combustion phase, which corresponds to one drive shaft revolution.

In order to identify properly this period, the camshaft is equipped in turn with a phonic wheel having teeth located on the circumference arranged so that the signal generated by a sensor 9 is different for the two drive shaft revolutions.

It should be noted that no standard layout of the phonic wheels teeth is provided for the camshaft, and that the second module 5 is flexible enough to be configured for processing a profile. The signal generated by the sensor 9 of the camshaft phonic wheel is, thus, input to the module 5 along with the count of the phonic wheel teeth coming from the "phonic wheel manager" module 4.

The "camshaft manager" module 5 processes these signals to generate an appropriate phase signal at each rotation of the phonic wheel. The module 5 may be also programmed by entering a desired phase variation or phase displacement between the camshaft signal and the signal indicating the crankshaft angle position, so that the system can be used with the controllers for variable timing engines.

A third module 6, referred to as the "injection manager" hereinafter, has the task of generating a series of useful signals for the "driver" 7 provided for driving the injectors or actuating the ignition. Because of the many existing types of these "drivers" and of the possible applications for any one "driver", the module 6 may be programmed to generate the driving signals according to a desired timing pattern.

This makes the module 6 as flexible as possible and also re-usable in different applications. By using a standard input/output interface I/O, the sequence of the output logic states can be stored inside the module 6, which outputs may be both PWM signals and stable binary logic signals in the '0/1' form. The injection profile thus internally stored may be described according to angles and/or times, allowing the outputs to go from one logic level to another, or when the drive shaft attains a given position (information supplied to the module 6 by the signals tooth_num and i_teeth from module 4, and signal cam_phase from module 5), or after a given lapse from the previous situation. This feature makes module 6 suitable both for use in applications where the amount of fuel to be injected is calculated in terms of time duration, and in applications where it is calculated in terms of the angular position of the drive shaft.

Briefly, the managing system 1 allows to determine automatically the angular position of the drive shaft and the engine cycle phase, so as to generate, according to these parameters, a series of signals useful to drive the injectors. All this in order to actuate the injection process exactly at the desired time.

The functionality of the Injection Coprocessor (managing system 1) is obtained by combining together the four modules "phonic wheel manager" 4, "camshaft manager" 5, "injection manager" 6 and "dec_inj_mgr" 13, as illustrated by the architecture depicted in FIG. 2A. The number of units of the module 6 and "dec_inj_mgr" module 13 depends on the number of the engine cylinders where the system 1 is to be used.

As said before, the first "phonic wheel manager" module 4 processes signals from which the drive shaft angular position can be obtained. This module is input the signal from the sensor 8 of the drive shaft phonic wheel. The module flexibility comes from the possibility of programming the values of n and m so as to suit the phonic wheel actually arranged on the drive shaft.

The second "camshaft manager" module 5 processes signals from which the engine cycle phase can be obtained. This module is input the signal from the sensor 9 of the camshaft phonic wheel. The module flexibility comes from that it can be programmed so as to fit the phonic wheel actually arranged on the camshaft both in fixed and variable timing engines.

The third "injection manager" module 6 has the task of generating appropriate signals for the injector driving "drivers" in order to actuate the desired injection profile stored inside the module. The module flexibility comes from that it can actuate the injection profile both according to the drive shaft angular position and after given lapses expire.

Let us now see the structure and function of the fourth module 13 denoted "dec_inj_mgr".

Figure 3A:
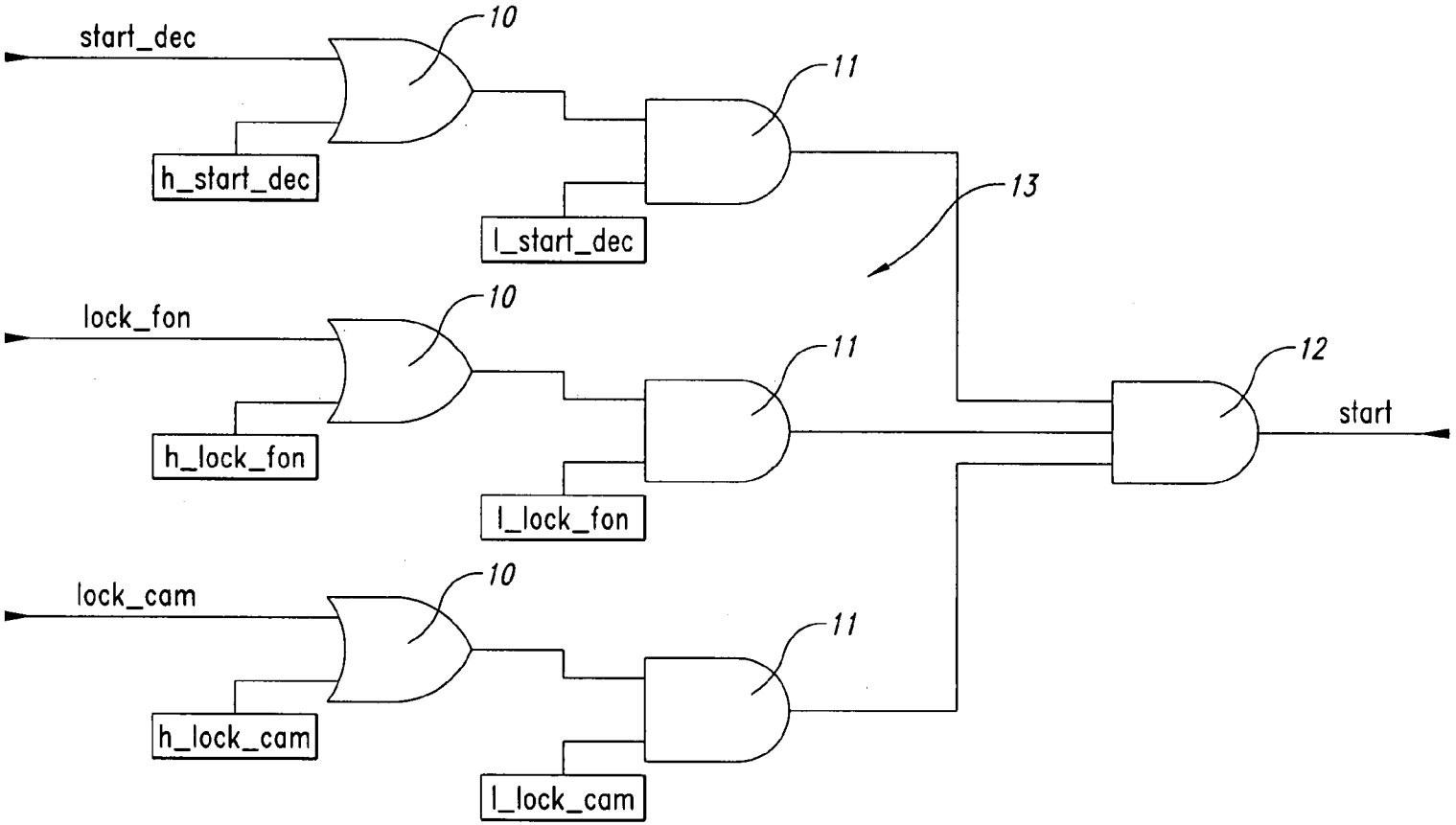
FIG. 3A is a schematic view of a detail of the architecture shown in FIG. 2A.

This module 13 is an enabling module, in the sense that it initiates module 6. Table 1 below shows the input and output signals of module 13. FIG. 3A shows the internal architecture of the module.

The module 13 comprises a network of logic gates being input signals start_dec, lock_fon and lock_cam, respectively indicating that module 6 is to be initiated and that modules 4 and 5 have detected the respective signals. An output logic gate 12, of the AND type, is input the respective outputs from three logic gates 11 with two inputs, of the AND type.

Each gate 11 is input a signal that is output by an input logic gate 10, and a signal having a predetermined logic value and being contained in a storage register.

The input logic gates 10 are of the OR type with two inputs. Each gate 10 receives one of the input signals, and on the other input, receives a signal having a predetermined logic value and being contained in a respective storage register.

The logic network of FIG. 3A may be formed of a different number and different types of logic gates. What matters is that the whole logic network can supply a logic signal to enable the module 6 when module 4 finds the drive shaft reference point, module 5 finds the engine cycle phase, and module 6 is ready to execute a sequence of operations stored up therein.

TABLE 1

| Signals | Description |
|---|---|
| Input | |
| lock_fon | Indicates that "phonic wheel manager" module 4 has found the reference point. |
| lock_cam | Indicates that "camshaft manager" module 5 has found the engine cycle phase. |
| start_dec | Indicates the value of the "start" internal register of "injection manager" module 6. |
| Output | |
| start | Indicates if module 6 is to be initiated. |

The framed signals are the internal registers of module 13. By using the standard I/O interface, these signals can be forced to a '0' logic value or to a '1' logic value. The default value for the registers whose name begins with "h" is '0', while for those beginning with "1" it is '1'. Thus, the "start" signal is only activated when the three input signals all have a logic value of '1', indicating that module 4 has found the reference point, module 5 has found the engine cycle phase, and module 6 has been programmed to perform its function only after the determination of the operational condition indicated by modules 4 and 5.

From the architecture of FIG. 3A it is evinced that the module 6 can be initiated to have the "injection coprocessor" module fully available as desired.

Table 2 below shows the input/output signals of the whole managing system 1. It should be noted that the system interacts outwards through a standard I/O interface, viz. an interface which comprises Control_bus, Address_bus and Data_bus.

TABLE 2

| Signals | Description |
|---|---|
| Input | |
| Control_bus | Standard communication interface. |
| Address_bus | |
| Data_bus (I/O) | Data_bus is bi-directional. |
| cam_signal | Signal from sensor 9 of camshaft phonic wheel. |
| fonica_signal | Signal from sensor 8 of drive shaft phonic wheel. |
| measured_diag | Measured diagnostics signal. |
| Output | |
| curr_out | Binary logic signals for power drivers 7. |
| pwm_out | PWM signals for power drivers 7. |
| rec_out | Reconstructed camshaft signal. |
| interrupt_inj | Interrupt signal of module 6. |
| interrupt_cam | Interrupt signal of "camshaft manager" module 5. |
| interrupt_fon | Interrupt signal from "phonic wheel manager" module 4. |

Each module, 4, 5, 6, or 13, is configured as desired by means of the standard communication interface. The "phonic wheel manager" module 4 begins to monitor a signal fonica_signal, and after finding the reference point, issues a signal lock_f. The module 4 also generates a signal lock_fon to indicate that the location of the reference point has been verified for a given number of times.

At this point, the signals tooth_num and i_teeth begin to indicate the drive shaft angular position.

The signal tooth_num is a counter of the phonic wheel teeth starting from the reference point. The signal i_teeth indicates an estimated position between two teeth of the phonic wheel.

The signals lock_f and tooth_num are input to the "camshaft manager" module 5, and so is the signal cam_signal. The module 5 processes the signal cam_signal from the activation of signal lock_f, and the process of determining the cycle phase is thus started.

The identification of the phase is pointed out by activating the signal lock_cam, and from now onwards, the phase indication provided by the signal cam_phase in relation to the signal teeth_cnt is effective.

The signals cam_phase and teeth_cnt generated by module 5, along with the signal i_teeth generated by module 4, are the primary inputs for module 6, once the latter is enabled by module 13.

Once initiated, module 6 processes the phase signal and the signals indicating the drive shaft angular position, and is able to carry out independently the injection process, consisting in generating the signals pwm_out and curr_out to drive the injector drivers 7 so as to implement the injection profile internally stored.

The signal teeth_cnt conveys the same type of information as the signal tooth_num, i.e. is a counter of phonic wheel teeth. The single difference is that the signal tooth_num starts counting afresh at each revolution of the drive shaft phonic wheel, while the signal teeth_cnt starts counting afresh at each revolution of the camshaft, i.e. every two drive shaft revolutions.

The module 5 is flexible enough to be programmed for the following situations:

1) signal teeth_cnt indicates the same count as signal tooth_num; and 2) signal teeth_cnt indicates a shifted (forwarded or delayed) count with respect to that of signal tooth_num of an amount that can be programmed in a register of module 5.

Thanks to this feature, the managing system 1 can also be applied to engines in which phase variation system is integrated, and allows extensive flexibility in implementing injection in a wide range of different modes.

The managing system 1 can be adapted for the widely different types of drive shaft and camshaft phonic wheels, as well as of automotive injector drivers, thanks to the extensive configurability of parameters afforded by the modules 4, 5, 6 and 13. This makes the system of this invention the more flexible and re-usable in different applications as possible.

With reference to FIGS. 1B to 6B, the architecture of an electronic device embodying the invention is shown. This electronic device is useful to determine the operating phase of an engine or motor 2, specifically but not limited to, a direct-injection four-stroke cycle motor with automatic determination of the drive shaft angular position and of the operating phase. The motor 2 comprises a drive shaft 20 in combination with a phonic wheel 19, and a camshaft 18 combined with a phonic wheel 17.

Figure 1B:
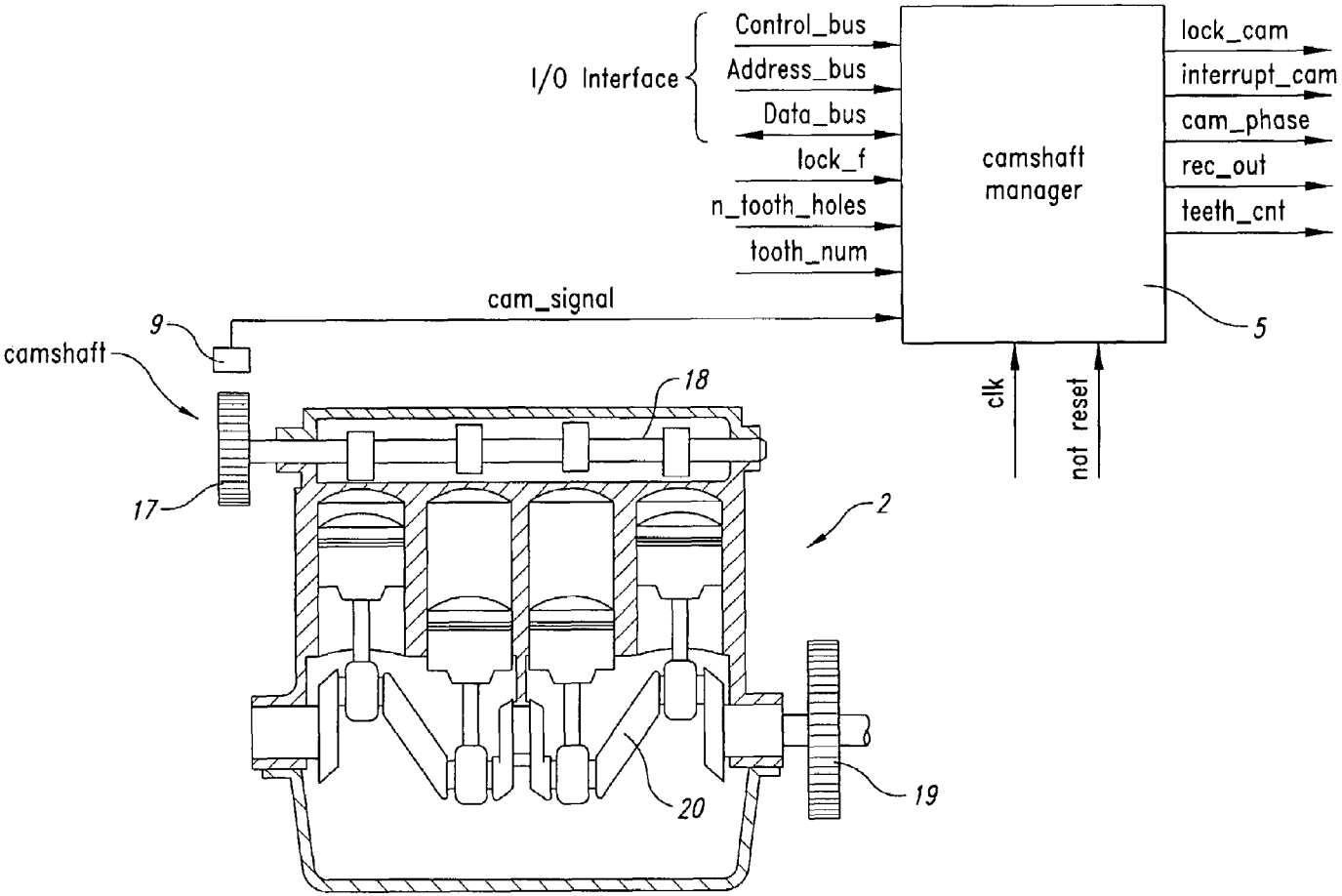
FIG. 1B shows schematically an endothermic injection motor associated with an electronic device for determining the motor operating phase, according to the invention.

The device is associated with an ECU, similar to the connection shown in FIG. 1A and of the same kind that is conventionally used in automotive applications for controlling this type of motor ignition and/or injection. A part of the device is represented in FIG. 1B by the block "Camshaft Manager" 5.

The device is primarily aimed at releasing the ECU from monitoring the motor operating phase.

The device has the task of processing electric signals indicating the motor operating phases. The device is input a signal from a sensor 9 of the phonic wheel 17 made rotatively rigid with the camshaft 18 of the motor 2.

The operating phases of a four-stroke are characterized by the movement of the piston in the cylinder, which is managed by the drive shaft 20, and by the position of the valves, which are managed by the camshaft 18. The piston moves toward the motor both with all the valves closed (compression phase or stroke) and with the exhaust valve open (exhaust phase). The opposite movement of the piston takes place either with all the valves closed (combustion/expansion phase or power stroke) or with the intake valve open (intake phase). Within one turn of the drive shaft, the piston completes both one movement toward the head both the opposite, because its connection to the drive shaft is established by a connecting rod. At the same time, the camshaft completes a half turn to manage the valves as appropriate.

Thus, the rotation ratio between the camshaft and the drive shaft is 1:2. The timing period for the injection to be actuated is between the compression and combustion/expansion phases, and corresponds to one drive shaft revolution. In order to identify this period, the camshaft 18 is provided with the phonic wheel 17 having a predetermined number of teeth allocated on the circumference of the wheel 17. Since the teeth have no standard distribution, the device can be programmed by storing the particular profile of the camshaft phonic wheel 17.

This signal is input to the device 1 along with a signal indicating the drive shaft angular position. From the elaboration of this signal, the "Camshaft Manager" injection coprocessor 1 generates a phase signal suitable for each phonic wheel 17 rotation.

Briefly, the invention provides a hardware module which is input both a signal from the sensor 9 of the phonic wheel 17 of the camshaft 18 and a signal indicating the drive shaft angular position, and outputs a series of signals from which the operating phase of the motor can be obtained, given a reference point.

The device may also be located next to controllers of units arranged on variable timing motors, since the modules inside the device can be programmed by inserting the desired timing variation between the camshaft signal and the drive shaft angular position signal.

Figure 3B:
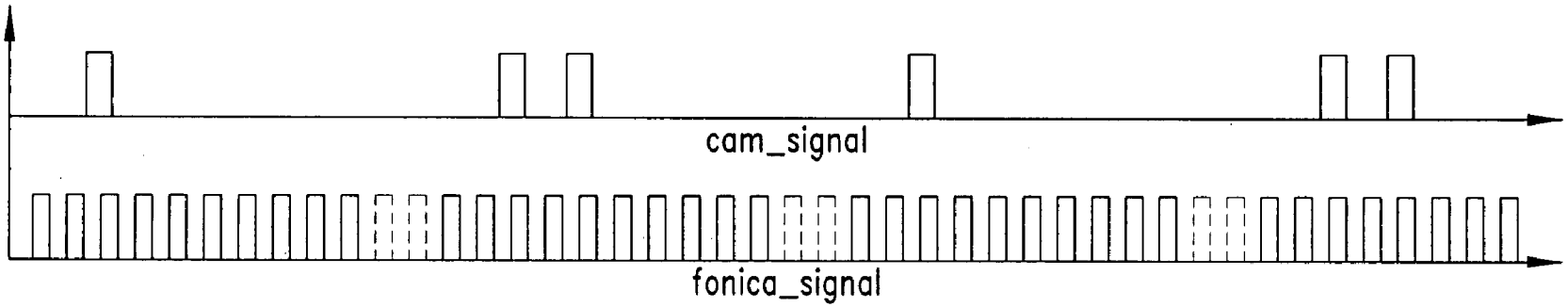
FIG. 3B shows schematically a digital signal issuing from a phonic wheel associated with the motor camshaft linked to the digital signal issuing from a phonic wheel associated with the drive shaft.

A basic diagram in FIG. 1B illustrates how the invention is applied. FIG. 3B shows the signal generated by the sensor of the drive shaft phonic wheel 19 compared with the signal from the camshaft phonic wheel 17. It can be seen in FIG. 3B how the profile of the cam signal changes for two successive rotations of the drive shaft.

The main function of the "Camshaft Manager" 5 of the device is to recognize the motor operating phase by analyzing the phonic wheel signal relating to the drive shaft angular rotation.

Figure 2B:
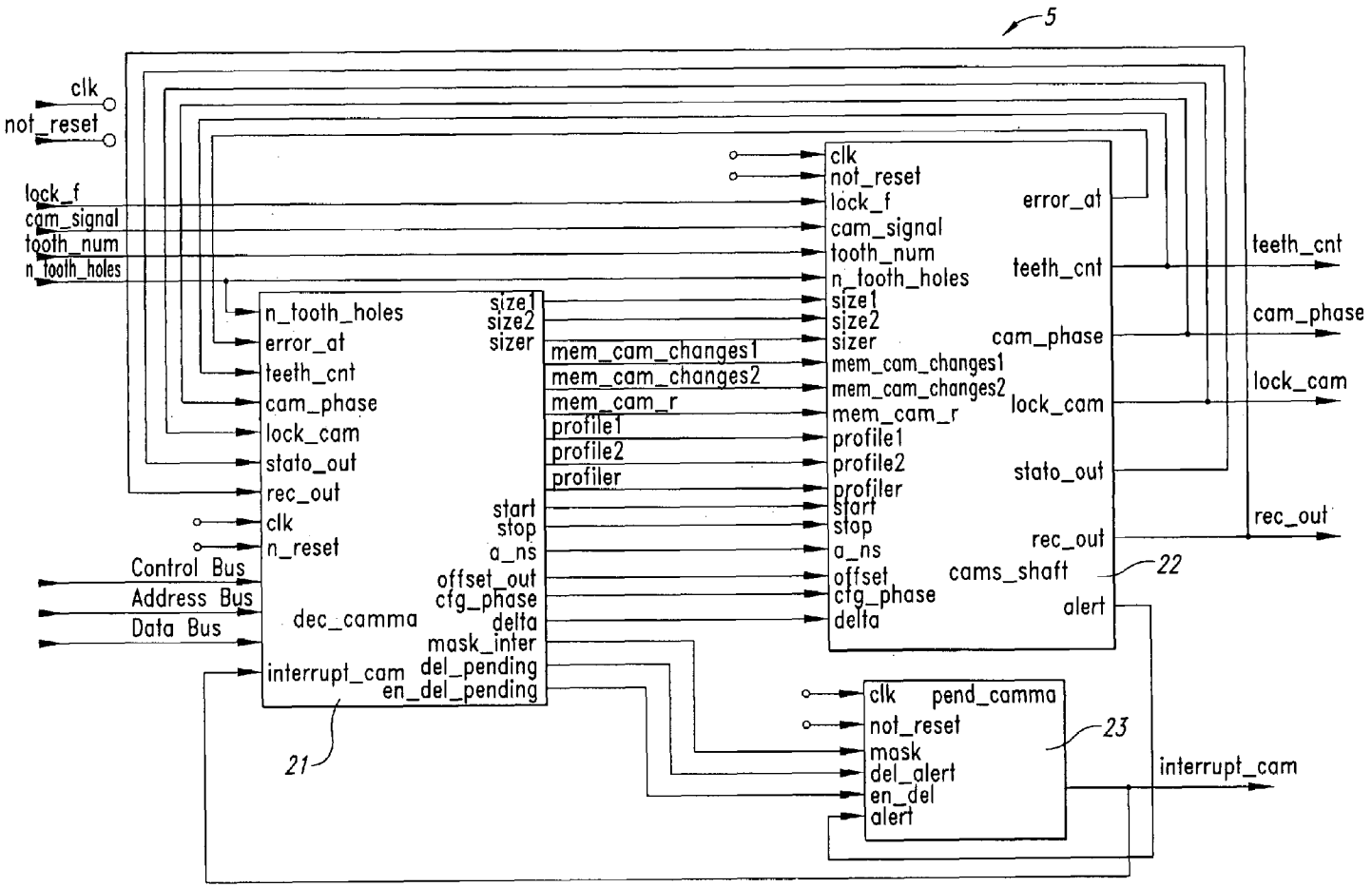
FIG. 2B is a schematic detail view of the device according to the invention.
Figure 2C:
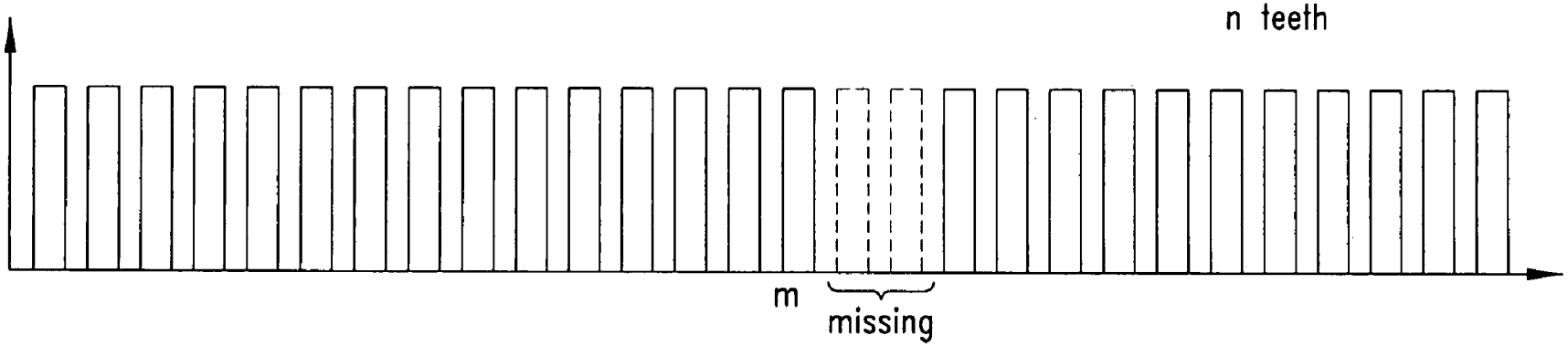
FIG. 2C shows a detailed schematic view of a digital signal emitted by a tone wheel associated to the drive shaft.

The "Camshaft Manager" 5 of the device comprises three modules 21, 22 and 23, also called "dec_camma", "cams_shaft" and "pend_camma", whose interconnections are shown in FIG. 2B.

The "dec_camma" module 21 performs the task of providing a standard interface toward the controller of the ECU such that the controller itself can manage the "Camshaft Manager" 5 of the device. Such a management is actuated by properly forcing the value of a set of internal registers of the "dec_camma" module 21.

The values of said registers represent the configuration parameters of the second "cams_shaft" module 22, forming the heart of the whole system. While normal operating phase, this module 22 forces the values of a second set of registers inside the first "dec_camma" module 21, from which the internal state and the results of the second "cams_shaft" module 22 can be found.

A general diagram of the hardware architecture of the "Camshaft Manager" 5 is shown in FIG. 2B.

Table 3 below shows the I/O input and output signals of the device.

TABLE 3

| Signals | Description |
|---|---|
| Input | |
| Control_bus | Standard communication interface. |
| Address_bus | |
| Data_bus (I/O) | Data_bus is bi-directional. |
| cam_signal | Signal generated by the circuit of the camshaft sensor. |
| lock_f | Indicates that the drive shaft phonic wheel reference is found. |
| n_tooth_holes | Total number of teeth and holes of the drive shaft phonic wheel. |
| tooth_num | Tooth counter for the crankshaft phonic wheel. |
| Output | |
| lock_cam | Indicates that the motor operating phase is found. |
| cam_phase | Indicates the motor operating phase. |
| rec_out | Desired camshaft profile. |
| teeth_cnt | Indicates the drive shaft angular position after one rotation of the camshaft. |
| interrupt_cam | Interrupt signal. |

The set of signals lock_cam, cam_phase and rec_out allows, whenever the motor operating phase to be found in connection with the drive shaft position, denoted tooth_num. The signal teeth_cnt is generated to indicate the drive shaft angular position in connection with one complete rotation of the camshaft; like tooth_num, it is a counter of the teeth of the drive shaft phonic wheel, except that it is reset every two drive shaft rotations.

The third "pend_camma" module 23 functions to generate an interrupt toward the controller of the injection unit of the motor, once the error signals generated by "cams-shaft" are input. Concurrently with the interrupt being generated, the relevant internal register of "dec_camma" is set, and from this the type of error generated by "cams_shaft" can be found.

The whole architecture of "Camshaft Manager" module 5 is structurally independent, and can be formed as an integrated circuit on a supporting board and standard bus interconnection. The motor ECU may also find place on this board.

Of course, there is no reason for the modules 21, 22 and 23, the device, and the ECU not to be formed in a common-shared integrated circuit of the system-on-chip variety, still retaining its operational independence.

Table 4 below shows the registers provided in the first "dec_camma" module 21, which can be read and/or written by means of the standard interface:

TABLE 4

| Register | Description |
|---|---|
| Output to "cams_shaft" | |
| start | Starts the state machine implemented in "cams_shaft" |
| stop | Stops the state machine implemented in "cams_shaft" and brings it back to its initial state ready to start again. |
| mem_cam_changes1 | Table of size1 items, containing the number-of-tooth values of the drive shaft phonic wheel where transitions occur on the cam signal during the drive shaft rotation relevant to phase zero. |
| profile1 | Indicates the expected value of the cam profile stored in mem_cam_changes1. |
| size1 | Indicates the number of items stored in the mem_cam_changes1 and profile1 tables. |
| mem_cam_changes2 | Table of size1 items, containing the number-of-tooth values of the drive shaft phonic wheel where transitions occur on the cam signal during the drive shaft rotation relevant to phase one. |
| profile2 | Indicates the expected value of the cam profile stored in mem_cam_changes2. |
| size2 | Indicates the number of items stored in the mem_cam_changes2 and profile2 tables. |
| mem_cam_r | Table of sizer items, containing the number-of-tooth values of the drive shaft phonic wheel where transitions occur for the reconstructed cam signal. |
| profiler | Indicates the expected value of the cam profile stored in mem_cam_r. |
| sizer | Indicates the number of elements stored in the mem_cam_r and profiler1 tables. |
| delta | Indicates the width of the interval around the timing moment when the system is expecting a tooth of the camshaft phonic wheel. |
| offset_out | Indicates the extent that the cam signal has to be shifted with respect to the drive shaft phonic wheel signal. |
| a_ns | Indicates whether the shift has to occur in the forward or the backward direction. |
| cfg_phase | Indicates if the teeth counter of the drive shaft phonic wheel is to be shifted. |
| Output to "pend_camma" | |
| mask_inter | Mask of the interrupts. |
| Input from "cams_shaft" | |
| error_at | Indicates the number of the tooth where the last error occurred. |
| teeth_cnt | Indicates the drive shaft angular position as phonic wheel teeth counter from 1 to 2* (n_tooth_holes). |

TABLE 4-continued

| Register | Description |
|---|---|
| cam_phase | Indicates the motor phase. |
| lock_cam | Indicates that the motor operating phase is found. |
| stato_out | Indicates the current state of the "cams_shaft" state machine. |
| rec_out | Desired camshaft profile. |
| Input from "pend_cams" | |
| pending | Indicates the type of error occurred. |

The second "cams_shaft" module 6 functions to find the motor operating phase, and to signal it properly in connection with the drive shaft 20 angular position. The phase is found by monitoring the signal from the camshaft sensor 9 (cam_signal) and the signal indicating the drive shaft angular position (tooth_num).

An example of the camshaft signal linked to the drive shaft signal is given in FIG. 3B. The signal fonica_signal is the signal generated by the sensor of the drive-shaft phonic wheel 19. In the example of FIG. 3B, the drive shaft phonic wheel 19 has ten teeth and two holes. The distribution of the teeth of the phonic wheel 17 of the camshaft 18 generates a different number of pulses for the two drive shaft rotations relating to the rotation of the camshaft.

The third "pend_camma" module 23 functions to generate an interrupt signal toward the controller of the ECU.

Briefly, the third "pend_camma" module 23 functions to generate an interrupt signal toward the controller of the ECU when a signal is input to the "dec_camma" module 21 which indicates the type of error occurred. The module 23 in turn generates a signal for module 21 to set properly the "pending" register, from whose reading the ECU controller then identifies the type of error so as to decide the action to be taken accordingly.

Let us now see the operation of the "cams_shaft" module 22 in greater detail.

The input "cams_shaft" signals are those shown in Table 4 under 'Output toward "cams_shaft"' section, plus camsignal, lock_f signals, and tooth_num signals among the input signals to the "Camshaft Manager" 5. The output signals are those shown in Table 4 under 'Input from "cams_shaft"' section, plus the alert signal indicating the type of error likely to occur.

Figure 4B:
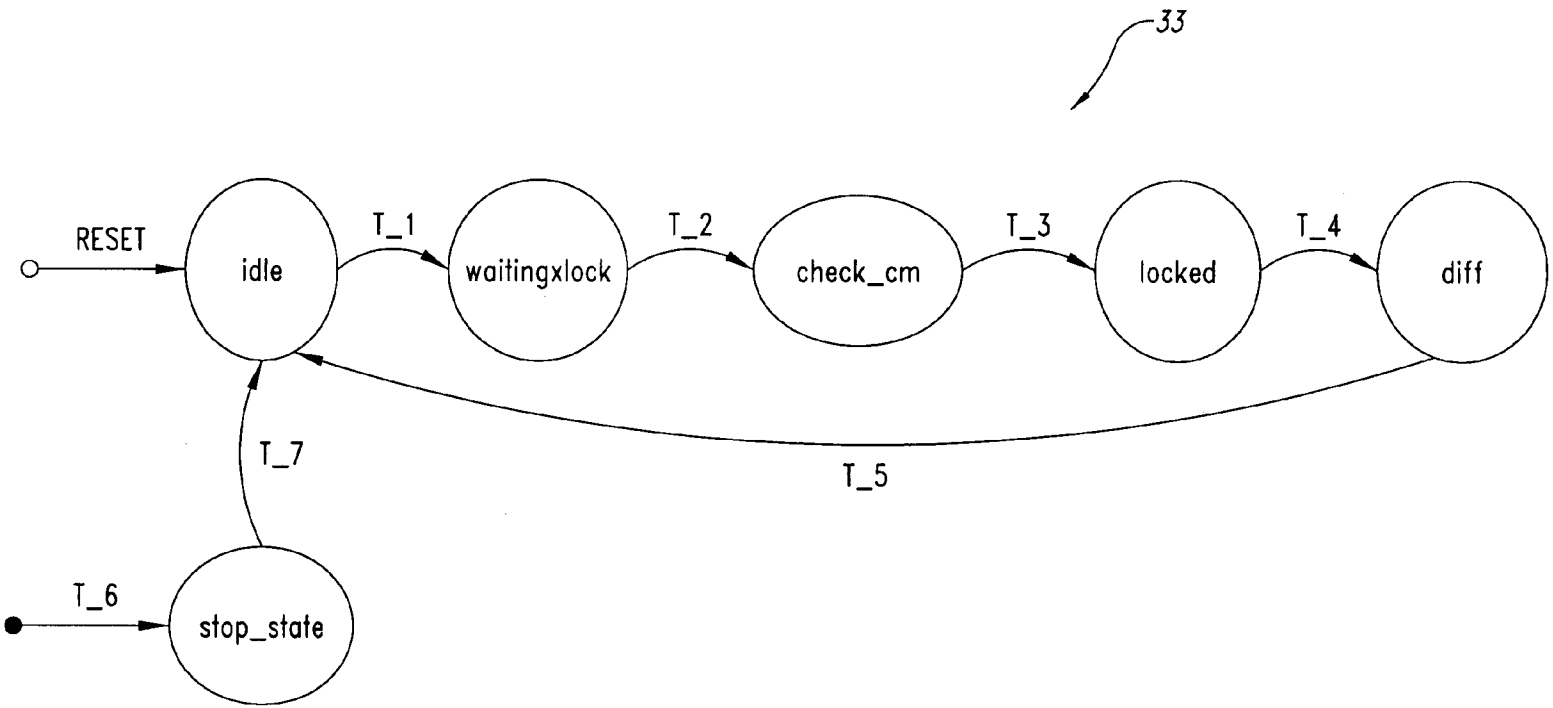
FIG. 4B is a diagram of a state machine illustrative of the operation of the device of FIG. 2B.

Shown in FIG. 4B is the state machine 33 describing the behavior of the "cams_shaft" module 22.

The initial state of the state machine 33 is called "idle", and is attained when starting and/or resetting the system. By activating the start signal, the state machine enters the "waiting x lock" state (transition T_1), and awaits the activation of the lock_f signal, indicating that the tooth_num signal is supplying the right drive shaft angular position values.

As the lock_f signal is activated, the state machine enters the "check_cm" state (transition T_2), where the motor operating phase is found.

This is done by simultaneously analyzing the mem_cam changes1-profile1 and mem_cam_chanes2-profile2 tables according to the value of the tooth_num signal at each instant. By way of example, the above tables are defined as follows:

TABLE 5

| Phase 0 | | Phase 1 | |
|---|---|---|---|
| mem_cam_changes1 | profile1 | mem-cam_changes2 | profile2 |
| 2 | 1 | 14 | 1 |
| 3 | 0 | 15 | 0 |
| | | 16 | 1 |
| | | 17 | 0 |

The table for Phase 0 will contain the transitions of the cam_signal signal during the first drive shaft rotation, and the table for Phase 1 will contain the transitions of the cam_signal signal during the second drive shaft rotation.

The values of the columns indicated as mem_cam_changes1 and mem_cam_changes2 should be entered in ascending order. The of the drive-shaft phonic wheel 19 considered in the example of FIG. 1B has twelve teeth (two of which are missing to mark the reference). As is known, for each revolution of the camshaft 18 this wheel makes two, so that twelve should be subtracted from the number indicated in mem_cam_change2 in order to identify the correct tooth, given that the tooth_num signal will indicate numbers from one to twelve.

Two pointers always indicates the item that must be examined in each table according to the current value of the tooth_num signal. From the transition to the "check_cm" state, the two pointers, indicating the first item in each table, are updated in such a way that they point to the first item that contains a tooth number larger than or equal to that being indicated by the tooth_num signal.

At each variation in the tooth_num signal on both tables a in parallel it is controlled that the item pointed to by the value of the current pointer contains the value indicated by tooth_num. If it does, it is further checked that the item pointed to by the other pointer does not contain the same tooth number value (added to the total number of teeth and holes), or, if so, that it does not contain the same transition value.

If the above condition is verified, the state machine 33 enters the "locked" state (transition T_3), otherwise the "check_cm" state is maintained until the condition is met. In the "locked" state, it is continually checked that the transitions of the cam_signal signal follow one another correctly and at the time points stored in the tables. The process is continued from the table that has caused the transition toward the "locked" state from the "check_cm" state, alternately between the two tables to track the stored profile.

In this state, a filtering process of sort may also be carried out on the cam_signal signal, by using the delta signal, which indicates the width of an interval around the tooth number where the transition is expected. The transition toward the "diff" state (transition T_4) occurs when, inside the time window being examined, the cam_signal signal does not track the profile stored in the tables.

Figure 5B:
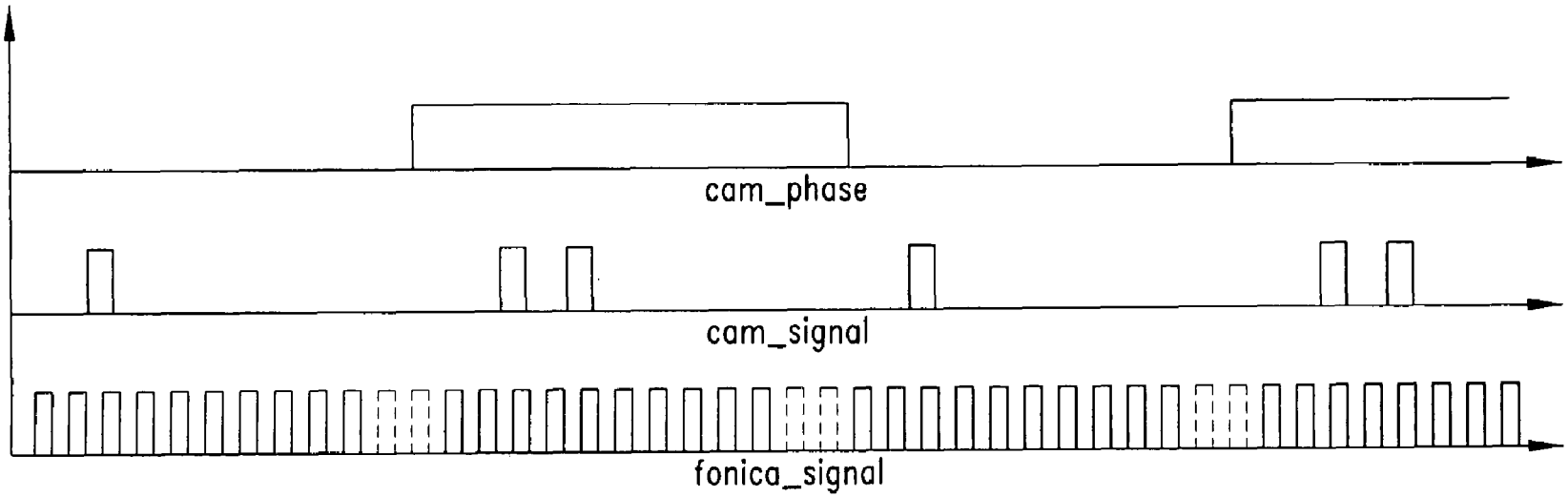
FIGS. 5B and 6B show, on their relevant diagrams with a common time base, a series of digital signals generated by the device of FIG. 2B, indicating the operating phase of the motor in connection with the camshaft phonic wheel signal and the drive shaft phonic wheel signal.

In this case, the value of tooth_num at which the error has occurred is indicated. In the "diff" state it is indicated that the phase can no longer be tracked properly, and that the state machine goes back to the "idle" state (transition T_5). During the stay in the "locked" state, the motor phase is indicated by the cam_phase signal, as shown in FIG. 5B.

Another feature of the "cams_shaft" module is that a camshaft signal can be obtained from the rec_out output signal, with the arbitrary profile stored in the profiler and the mem_cams_r tables, in relation to the tooth_num signal. An example is given in the following Table 6, where the signal denoted rec_out has the herebelow profile:

TABLE 6

| mem__cam__r | profiler |
|---|---|
| 6 | 1 |
| 7 | 0 |
| 9 | 1 |
| 10 | 0 |
| 13 | 1 |
| 14 | 0 |
| 19 | 1 |
| 20 | 0 |

Thanks to the features previously described, the device can be applied to any motor type equipped with a camshaft phonic wheel, and can be adapted for any type of phonic wheels employed in the automotive industry.

All this is thanks to the extensive configurability of the parameters of modules 21, 22 and 23 which make the device of this invention the more flexible and re-usable in different applications as possible.

With reference to the drawings, FIGS. 1C to 5C globally and schematically indicates the structure of an electronic device realized according to the present invention for determining the angular position of a driveshaft 20 in internal combustion engines 2, in particular but not exclusively, a direct-injection four-stroke engine with automatic determination of the drive shaft angular position and of the operating phase.

The electronic device is associated with an ECU similar to the connection shown in FIG. 1A, of a conventional one as it is widely used in automotive applications for controlling the ignition and/or injection of these types of engines. The device is schematized in FIG. 1C by the "Tone wheel manager" block 4.

The main task of the electronic device is that of releasing the electronic control unit from the monitoring of the drive shaft angular position.

The device has the task of elaborating electric signals to obtain the angular position of the drive shaft. Such device receives an input signal from a sensor 8 of a tone wheel 19, which is integral in rotation with the driveshaft 20.

Tone wheels comprise a predetermined number n of teeth arranged on the circumference of wheel 19 and equidistant from one another. A small group of adjacent teeth m is omitted for defining a point of reference on the wheel. Sensor 8 generates a signal from which the device searches the point of reference and emits a signal as the reference is found, and a further signal indicating how many teeth have passed after the point of reference.

More in particular, the teeth counter indicates the position of the drive shaft 20 with an accuracy of (360/n)°. To obtain a higher accuracy, the device generates a further signal that indicates the intermediate position between two teeth with a default resolution.

In substance, the hardware module devised with the present invention receives an input signal from a tone wheel sensor and provides a series of output signals from which it is possible to trace the angular position of the drive shaft given by a known point. It was decided to use as tone wheels those that must be used in the automotive field, practically those having equidistant teeth with the omission of a certain number of adjacent teeth to generate the known point reference. This type of tone wheels generate a digital signal as that shown in FIG. 2C.

Figure 1C:
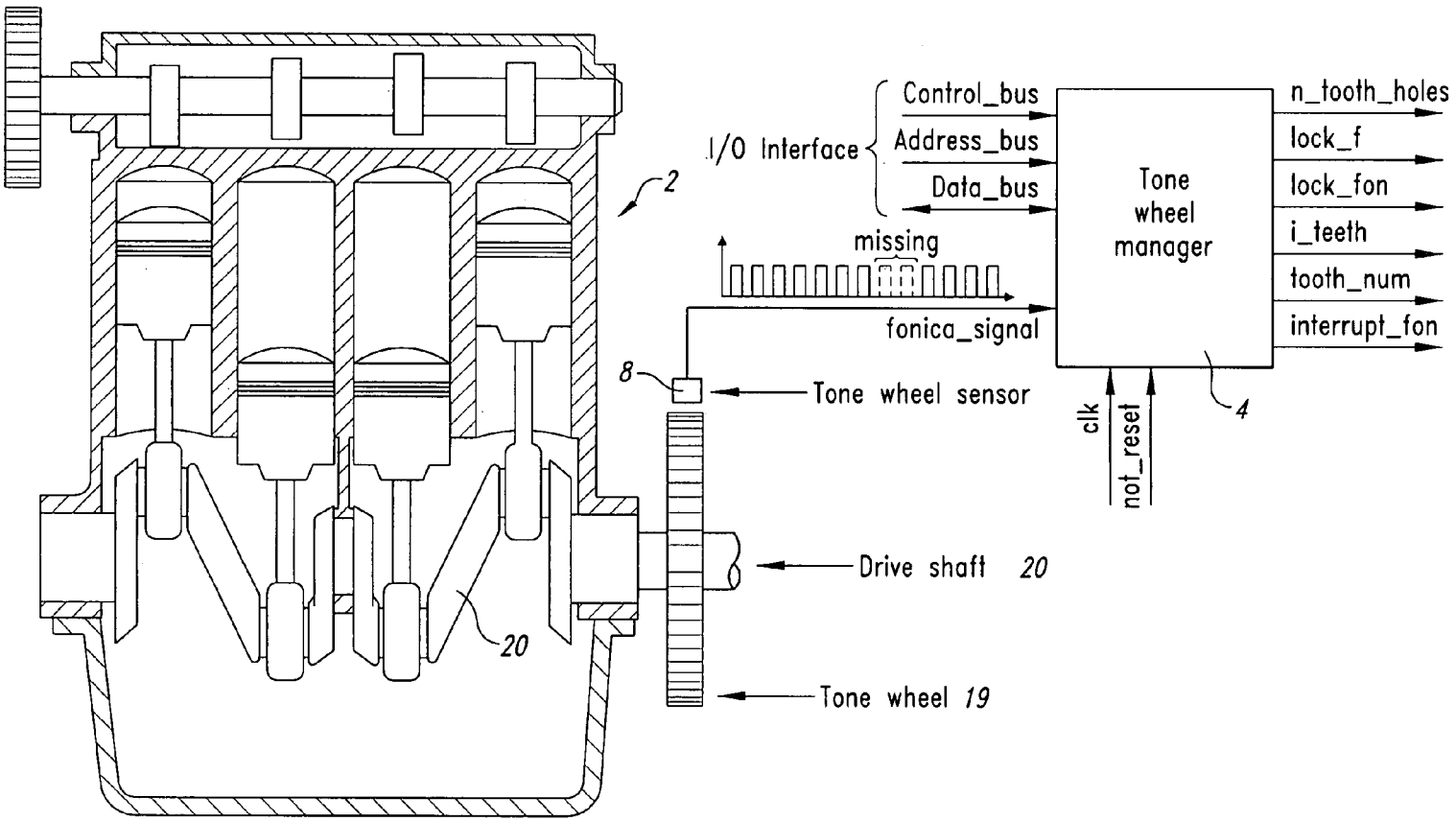
FIG. 1C shows a schematic view of an endothermic injection engine associated to an electronic device realized according to the present invention for determining the angular position of the drive shaft.

FIG. 1C shows a layout of the application of the invention. The absence of pulses occurs at the tone wheel holes (absence of teeth). Actually, the main task of "Tone wheel manager" 4 is to detect properly this reference that identifies a particular position of the drive shaft 20.

"Tone wheel manager" 4 comprises three modules 24, 25 and 26, also called "decoder_fonica", "fsm_fonica" and "pend_inter", respectively, each intended to perform a predetermined function described in detail hereinafter. The entire "Tone wheel manager" 4 is structurally independent and can be realized as integrated circuit and be housed on a standard bus-interconnection and support board. This board may also house the engine ECU.

Of course, nothing prevents "Tone wheel manager" 4, as well the ECU, from being realized on a single integrated circuit of the "system on chip" type, even maintaining their functional independence.

Figure 3C:
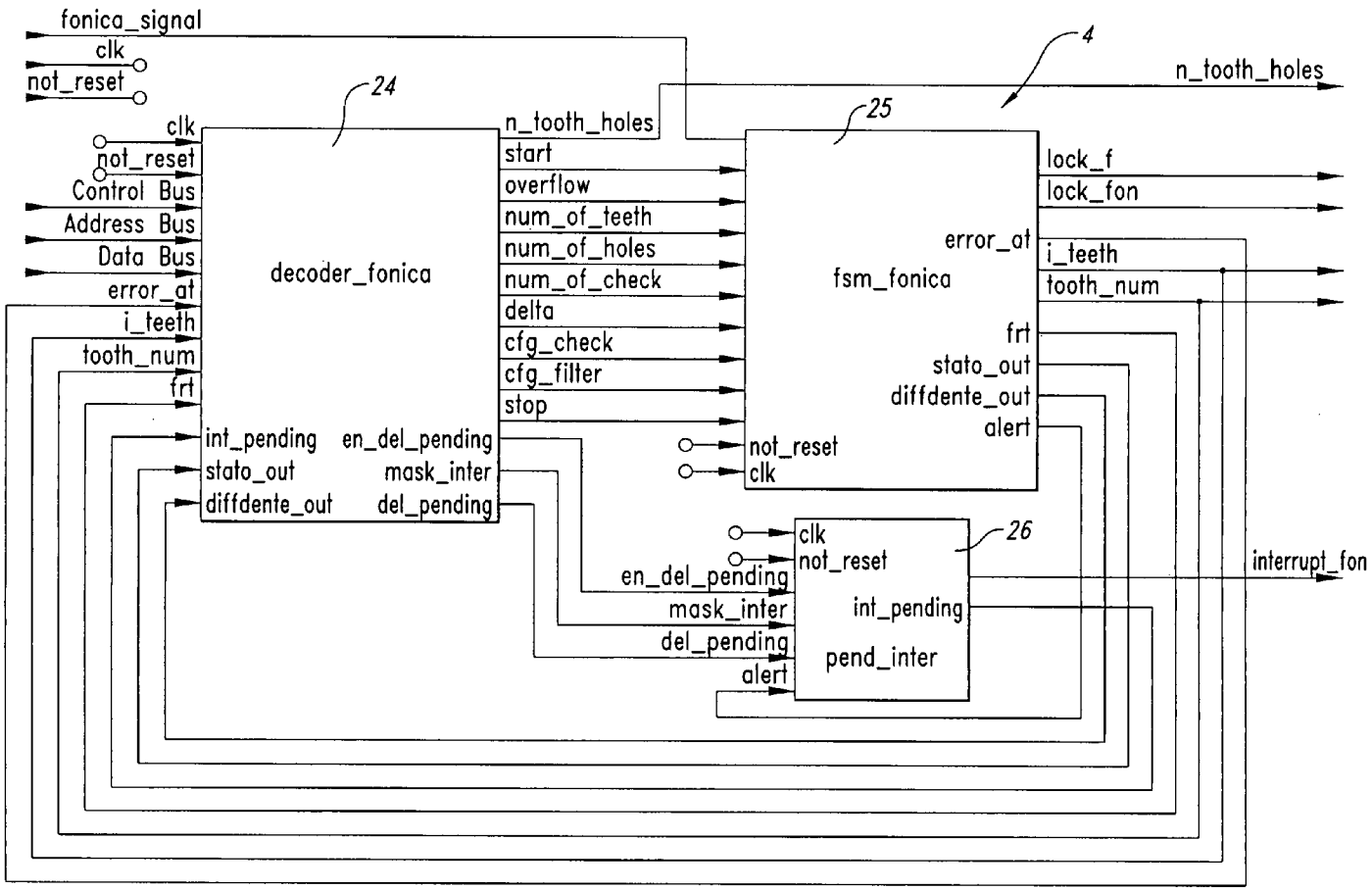
FIG. 3C shows a detailed schematic view of the device according to the invention.

A general diagram of the hardware architecture of "Tone wheel manager" 4 is shown in FIG. 3C.

The following Table 7 reports the input and output I/O signals of "Tone wheel manager" 4.

TABLE 7

| Signals | Description |
|---|---|
| Input | |
| Control__bus | Standard I/O communication interface. |
| Address__bus | The Data bus is bi-directional. |
| Data__bus (I/O) | |
| fonica__signal | Signal generated by the tone wheel sensor circuit. |
| Output | |
| n__tooth__holes | Total number of teeth and holes |
| lock__f | This indicates that the point without teeth in the tone wheel has been found. |
| lock__fon | This indicates that the programmed number of revolutions of the drive shaft has been performed from the moment of the activation of the lock signal. |
| tooth__num | This indicates the current number of tooth of the tone wheel. This signal allows tracing the angular position of the drive shaft after the activation of the "lock" signal. |
| i__teeth | This indicates an intermediate position between two adjacent teeth of the tone wheel with a predetermined accuracy. |
| interrupt__fon | Interrupt signal. |

The task performed by module 24 "decoder_fonica" consists in providing a standard interface toward the ECU, in order to allow the controller embedded into the control unit to manage some registers internal to module 24 "decoder_fonica".

The following Table 8 describes the registers embedded in this module 24 that can be accessed in reading and writing mode through the standard interface.

TABLE 8

| Register | Description |
|---|---|
| Output to "fsm__fonica" | |
| start | Starts the state machine implemented in "fsm__fonica". |
| stop | Stops the state machine implemented in "fsm__fonica" restoring its original status waiting for a new start-up. |
| overflow | Sets the waiting time limit so that the lack of teeth in this time interval indicates a system error status. |

TABLE 8-continued

| Register | Description |
|---|---|
| num_of_teeth | This indicates the tone wheel number of teeth. |
| num_of_holes | This indicates the tone wheel number of holes. |
| num_of_check | This indicates the number of revolutions of the drive shaft to be waited after the lock before passing to the injection phase. |
| delta | This indicates the extent of the interval around the time instant in which the system expects a tone wheel tooth. |
| cfg_filter | Enables or disables the digital filter to be applied on the signal transmitted by the tone wheel. |
| cfg_check | This indicates whether it is necessary to reset, in case of error, the count of already executed checks. |
| Output to "pend_inter" | |
| mask_inter | Interrupt mask |
| Input from "fms_fonica" | |
| error_at | This indicates the number of tooth where the last error occurred. |
| tooth_num | This indicates the number of the current tone wheel tooth. |
| i_teeth | This indicates an intermediate position between two adjacent teeth of the same tone wheel with a fixed accuracy. |
| frt | Free running timer. |
| stato_out | This indicates the current status of the state machine of the fsm_fonica". |
| diffdente_out | This indicates a value from which it is possible to trace the revolution speed of the drive shaft with the help of the following expression: $rmp = \frac{f * 60}{n_tooth_holes * diffdente_out}$ where f is the system clock frequency (clk). |
| Input from "pend_inter" | |
| pending | This indicates the type of error that has occurred. |

The values of these registers represent the configuration parameters of module 25 "fsm_fonica" which is the core of the entire device. Such module 25, in turn, during normal functioning, forces the values of a second set of registers internal to module 24 "decoder_fonica", from which it is possible to trace the internal status and the results of module 25 "fsm_fonica".

The set of signals lock_f lock_fon, tooth_num and i_teeth allows to identify at any time the angular position of the drive shaft.

The task of the third module 26 "pend_inter" consists of generating an interrupt signal toward the engine ECU once the error signals generated by module 25 "fsm_fonica" have been received in input.

In substance, the task of this third module 26 "pend_inter" consists of generating an interrupt signal toward the controller of the ECU when a signal indicating the type of error occurred is received in input from module 25 "fsm_fonica". In turn, module 26 generates a signal for module 24 "decoder_fonica" for properly setting the "pending" register, from whose reading the controller of the ECU determines the type of error so as to decide the action to be taken.

The emission of the interrupt signal, therefore, also sets the related register internal to module 24 "decoder_fonica", from which it is possible to determine the type of error generated by module 25 "fsm_fonica".

Below is a more detailed description of the operation of module 25 "fsm_fonica".

The task of module 25 "fsm_fonica" consists of detecting the drive shaft reference and then providing its position moment by moment. The reference search and the subsequent calculation of the position occur by constantly monitoring the signal transmitted by the tone wheel (fonica_signal).

After that, as the start signal (start) is received, module 25 "fsm_fonica" waits for the arrival of two teeth in order to determine a first prediction of the time interval where the next tooth should be expected. The search for the point in the tone wheel where m teeth are missing starts at this point. Once such reference has been detected, module 25 emits a corresponding signal and the position of the driveshaft 20 is indicated by a tooth counter that begins counting from the point of reference.

The input signals of module 25 "fsm_fonica" are indicated in Table 8 in the section 'Output toward "fsm_fonica"'; moreover, the signal fonica_signal included among the input signals of the device in Table 7 should be considered, as well.

Output signals are also indicated in Table 8 in section 'Input from "fsm_fonica"'; moreover, the following signals should also be considered: ready, lock_f, lock_fon, included among the output signals of the device in Table 7.

Figure 4C:
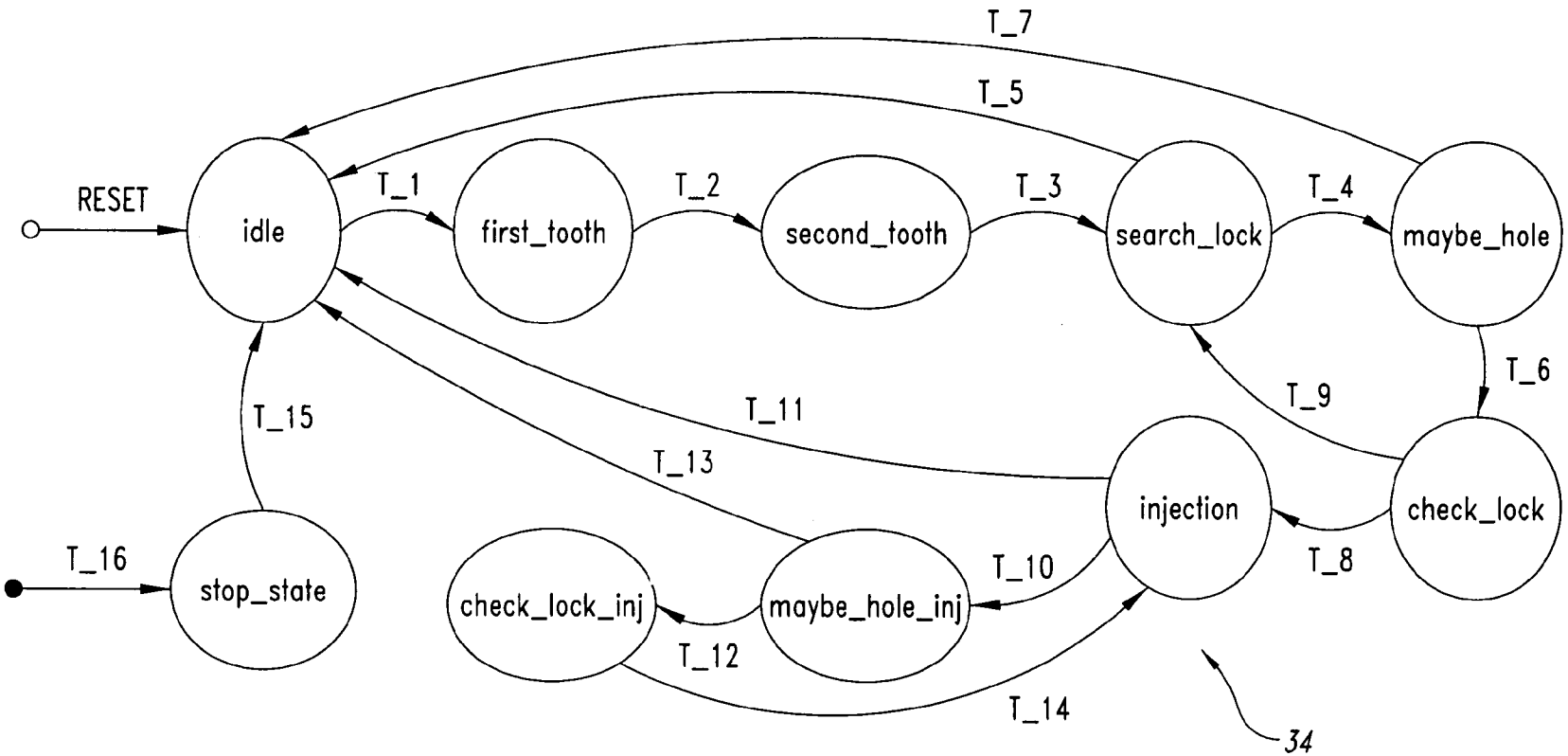
FIG. 4C shows the layout of a state machine that describes the operation of the device of FIG. 3C.

FIG. 4C schematically shows a state machine 34 that describes the functioning of module 25 "fsm_fonica".

The initial status of the state machine 34 is called "idle" and this is the status upon the system start-up and/or after a reset.

By activating the start signal, the state machine 34 passes through the "first_tooth" status (transition T_1), where the first pulse from the tone wheel sensor is expected.

In this status, the count of a timer frt starts and the ready signal is disabled, simply meaning that the device is on.

Upon the reception of the first pulse of the fonica_signal signal, the state machine 34 passes through the "second_tooth" status (transition T_2), where a second pulse is expected. During such transition, the current value of the timer is stored to the count1 register, indicating the instant in which the pulse from the fonica_signal signal has been received.

When the second pulse of the fonica_signal signal is received, the current value of the timer is stored to the count2 register, and the state machine 10 shifts to the "search_lock" status (transition T_3).

In this status, the system checks that any subsequent pulse of the fonica_signal signal occurs within a fixed temporal window or that, within such window, no pulse occurs, to pass through the tone wheel point of reference search status.

Figure 5C:
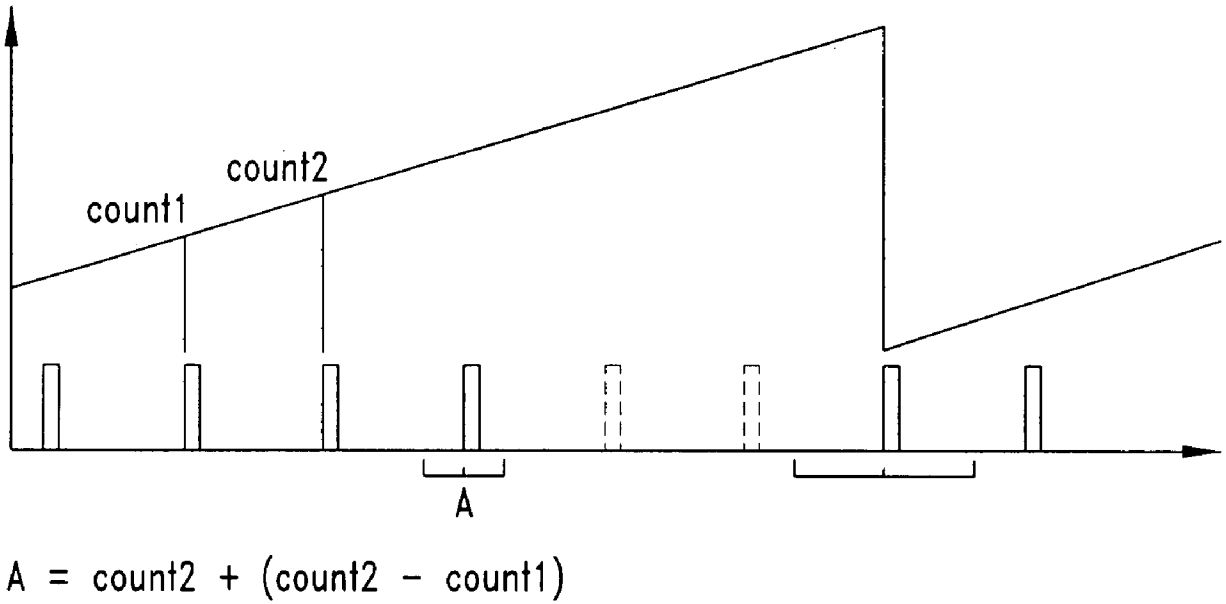
FIG. 5C shows a diagram with the type of digital signal treated by the device according to the invention.

The temporal window is thus determined: the difference (count2-count1) is added to the count 2 value to determine the center of the interval A when the next pulse is expected; the extremes of the interval are given by the delta signal, which indicates the number of sub-intervals by which to move from the center rightwards and leftwards; the extent of the sub-interval is given by the ratio (count2-count1)/n, with fixed n. The whole is schematically shown in FIG. 5C.

On the other hand, if in the "search_lock" status for the first time, this status is maintained until all pulses of tone wheel 19 have been received within the related temporal window and the transition to the "maybe_hole" status (transition T_4) occurs when there are no pulses left in the temporal window which is being monitored. The system returns to the "idle" status (transition T_5) to start the reference search again if a pulse not falling within the related temporal window is received.

The search for the remaining "holes" continues in the "maybe_hole" status. Each time interval that must elapse without receiving pulses is calculated by assuming that in the previous interval a pulse occurred exactly at the center of the interval, and the extent considered is given by the delta parameter multiplied by the number of missing teeth.

After checking the last "hole", a pulse is expected within the related temporal window; in the positive case, the state machine 34 passes through the "check_lock" status (transition T 6) where the timer is restarted, the tooth counter is reset and the lock_f signal is activated to indicate that the reference has been found. In the negative case, the state machine passes through the "idle" status (transition T_7). Transition from this status depends on the num_of_check register value; if it has been programmed with a number higher than zero, the system returns to the "search_lock" status (transition T_9) to execute a further check on the identification of the point of reference for a number of times equal to the programmed value.

In this further case, it is also possible to carry out a cross-check with the tooth counter, which starts upon the activation of the lock_f signal. With the activation of the lock_f signal, further checks are performed, depending on the cgf_filter and cfg_check register programming. With the cfg_check equal to one, in case of error, the return to the "idle" status does not reset the counter that indicates the number of times the check on the point of reference location has been already carried out. With the cfg_filter equal to one, the transition to the "idle" status does not occur, but a signal is generated to indicate the type of error occurred, so as to generate an interrupt toward the controller to decide the action to be taken.

Once the check of the location of the point of reference has been carried out the desired number of times, the system passes through the "injection" status (transition T_8), where the lock_fon signal is activated as well. In the three states of "injection", "maybe_hole_inj", "check_lock_inj" the state machine operates in a way similar to the three states of "search_lock", "maybe_hole", "check_lock" after detecting the point of reference (activation of the lock_f signal): the check of the proper succession of teeth and their absence is carried out in the same way. At any time, from any state, by activating the stop signal, the state machine 10 passes through the "stop_state" status (transition T_16); when this signal is interrupted, it passes through the "idle" status (transition T_15).

Thanks to the features described above, the device can be applied on any type of engine provided with tone wheel and is capable of being adapted to the wide variety of tone wheels for drive shafts used in the automotive field.

The above, thanks to the wide parameter configurability of modules 24, 25 and 26 that make the device, according to the invention, very flexible and usable in several applications.

With reference to the drawings, FIGS. 1D to 8D globally and schematically indicates the hardware architecture of an automatic system for drive and managing the injection and/or ignition of an endothermic engine 2, in particular a direct-injection four-stroke engine with automatic determination of the drive shaft angular position and of the operating phase.

A system 6 is associated to an ECU, similar to the connection shown in FIG. 1A of a conventional one as widely used in automotive applications for controlling the ignition and/or injection of these types of engines. System 6 is schematized in FIG. 1D by the "Injection manager" block.

The main task of system 6 is to release the Engine control ECU of the task of enabling the piloting of the means in charge of the injection and/or ignition of engine 2.

In practice, the time instant in which injection or ignition should be actuated is a critical parameter since the optimum combustion conditions depend on it to generate the smallest quantity of polluting substances.

The object of the present invention is that of defining the architecture of a modular hardware system which should generate a series of signals useful for the drivers 7 in charge of driving the injectors. Given the variety of types of these drivers 7 and of the possible applications using a same driver, system 6 can be programmed so as to generate driving signals having the desired time pattern. This makes the system according to the invention very flexible and reusable in several applications.

Thanks to a standard I/O interface it is possible to store the sequence of the output logical states inside the module; such states may be of the PWM type, both steady at a logical level "0" or "1".

The internally stored injection profile can be described on the basis of angles and/or times, thereby allowing the shift from a logical output level to the other when the drive shaft reaches a fixed position, or after a certain time interval from the previous situation.

This peculiarity of system 6 makes it usable both in applications where the quantity of fuel to be injected is calculated in terms of time in which the injector is open, and in applications wherein the quantity of fuel is calculated in terms of the drive shaft angular position.

Figure 1D:
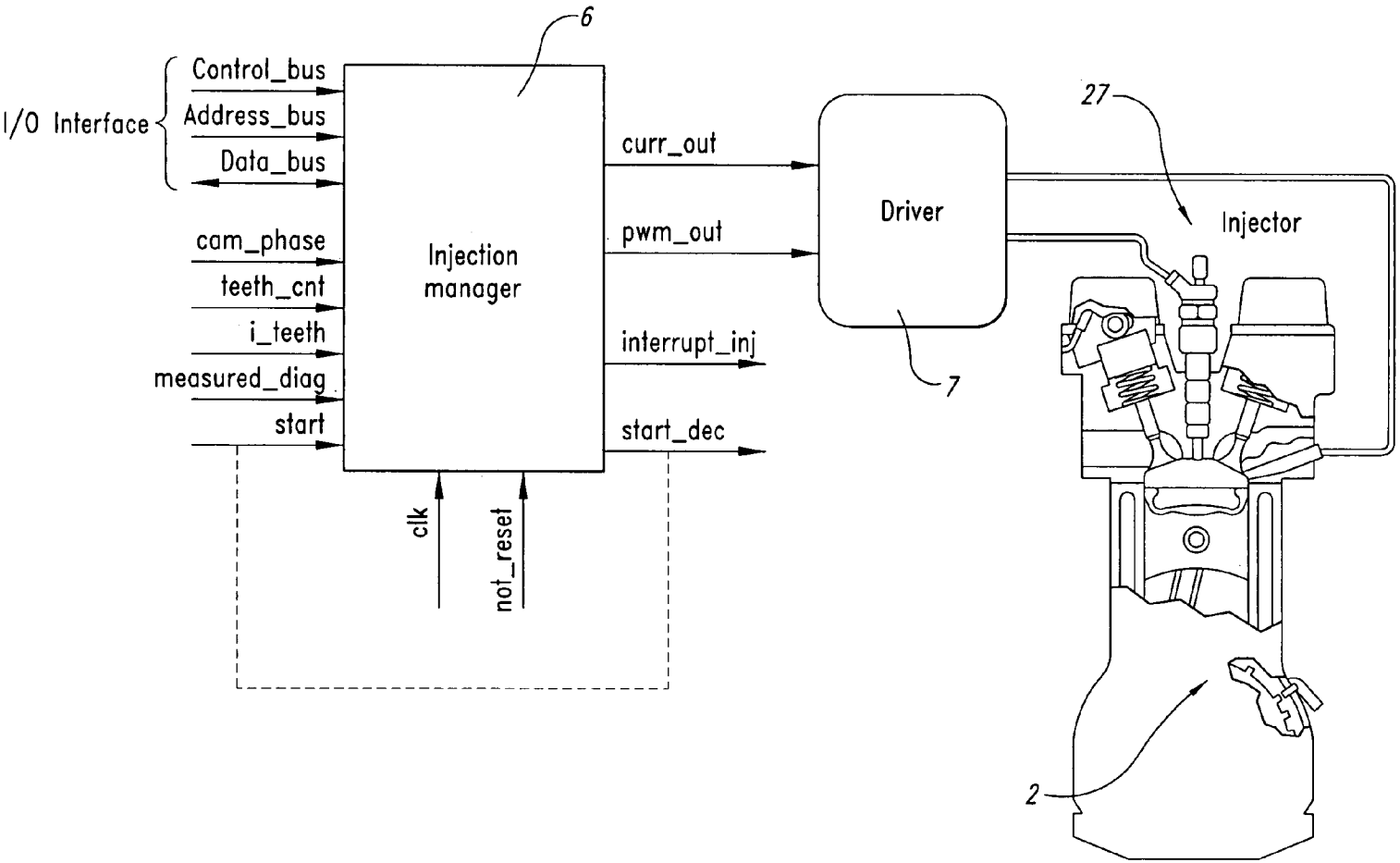
FIG. 1D shows a schematic view of an endothermic injection engine associated to an injector driving driver associated to a system for driving and managing the ignition and/or injection process according to the present invention.

FIG. 1D shows a layout of the invention.

System 6 exhibits a plurality of inputs and outputs described in the following Table 9:

TABLE 9

| Signals | Description |
|---|---|
| Input | |
| Control_bus | Standard communication interface. |
| Address_bus | The Data bus is bi-directional. |
| Data_bus (I/O) | |
| cam_phase | This indicates the engine operating phase |
| teeth_cnt | This indicates the drive shaft angular position with the precision given by the number of teeth of the drive shaft tone wheel. |
| i_teeth | This indicates an estimated angular position between two teeth of the drive shaft tone wheel |
| measured_diag | Diagnostic signals |
| start | Start signal for module internal state machines |
| Output | |
| curr_out | STEADY signals |
| pwm_out | PWM signals |
| Interrupt_inj | Interrupt signal |
| start_dec | This indicates if the internal start register is activated |

The output signal "start_dec" can be connected to the input signal "start" to start the entire system by writing on the internal register "start", as highlighted by the broken line between the two signals in FIG. 1D.

Figure 2D:
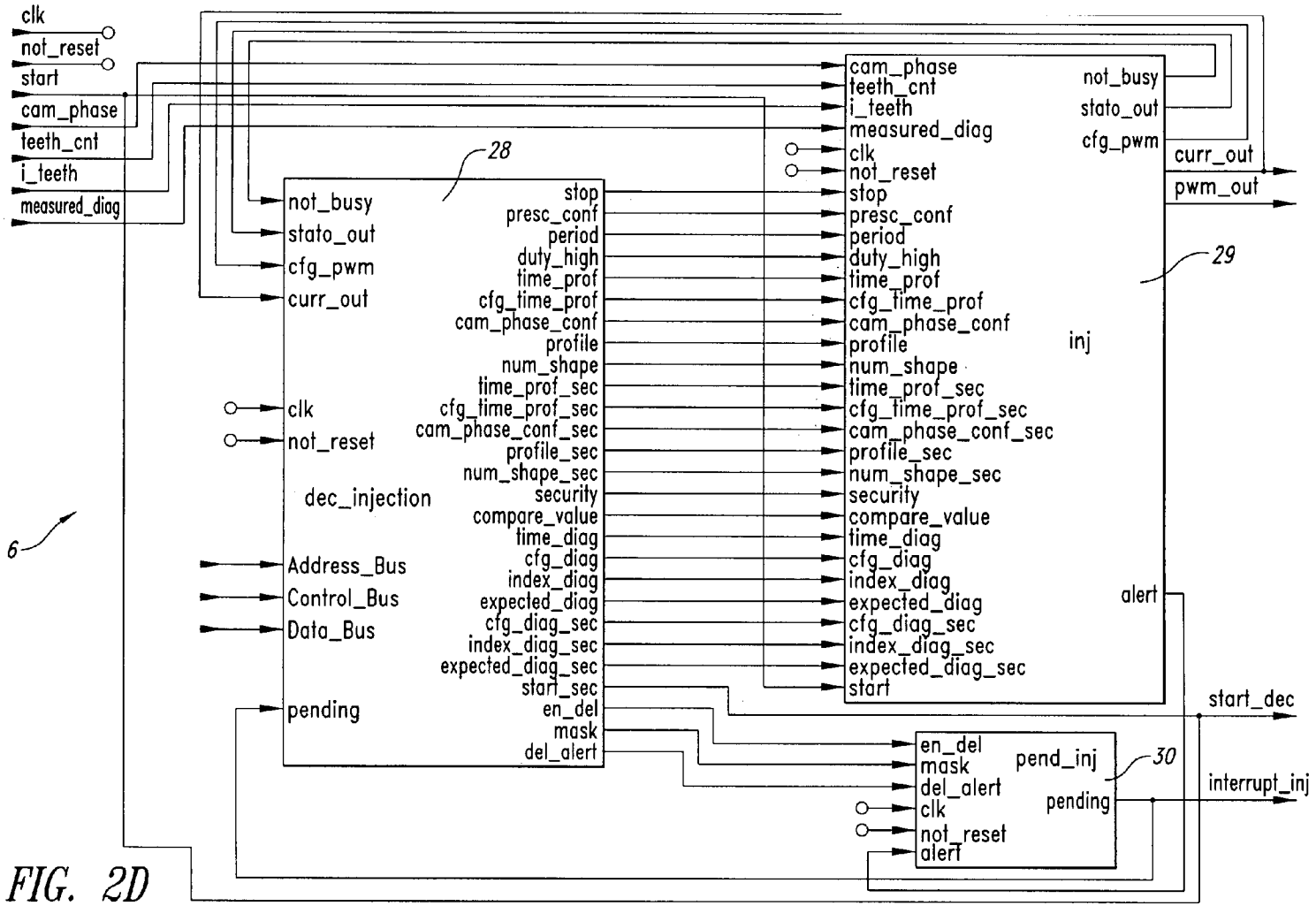
FIG. 2D shows a schematic block view of the architecture of the piloting system according to the present invention.

A general diagram of the hardware architecture of the driving system 6 is shown in FIG. 2D.

System 6 comprises three modules 28, 29 and 30, each performing a specific function in order to reach the object of the present invention. The entire system 6 is structurally independent and can be realized as integrated circuit and be housed on a standard bus interconnection and support board. Such board may also house the engine ECU.

Of course, nothing prevents system 6 and the ECU from being realized on a single integrated circuit of the "system on chip" type, even maintaining their functional independence.

The "Injection manager" block has a modular structure and comprises the three modules 28, 29 and 30, respectively called "dec_injection", "inj" and "pend_inj". FIG. 2D shows such modules and their interconnections.

The task module 28 "dec_injection" should perform consists in providing a standard interface toward the ECU in order to exchange signals with such engine control units to regulate the activity of the "Injection manager"; this is obtained by suitably forcing the value of a set of registers internal to module 28 "dec_injection".

The values of the above registers represent the configuration parameters of module 29 "inj" which is the core of the entire injection manager 6.

This module 29, during normal operation, forces a second set of registers internal to module 28 "dec_injection" from which it is possible to trace the internal status and to the results of module 29 "inj".

The set of signals curr_out and pwm_out allows the driving of a wide variety of car injector drivers 7 in order to actuate the desired injection profiles.

The task of module 30 "pend_inj" consists of generating an interrupt signal toward the engine injection control unit once the error signals generated by module 29 "inj" have been provided in input.

The generation of an interrupt signal also defines the value of the related register internal to module 28 "dec_injection", from which it is possible to detect the type of error generated by module 29 "inj".

The operation of module 28 "dec_injection" will now be described in deeper detail.

The task of module 28 consists of providing a standard Input/Output interface toward the ECU controller, so as to define the functionality of system 6 by suitably programming the registers embedded therein. Moreover, it transfers the value of these registers to module 29 "inj".

The following Tables 10, 11, 12 and 13 describe the registers embedded in module 28 "dec_injection"; these registers can be read/written via the standard interface:

TABLE 10

| Register Type | Description |
|---|---|
| Output to module 5 "inj" | |
| start | Its status is reported by the output "start_dec" |
| stop | Stops the state machine implemented in "inj" restoring its original status waiting for a new start. |
| presc_conf | Prescaler of the timer internal to module "inj" |
| period | Period of the PWM signals to be generated |
| duty_high | Table containing a set of duty-cycle values of the PWM signals to be generated |
| security | This indicates if the security condition is enabled |
| compare_value | Watchdog value |
| time_diag | This indicates the instants in which diagnostics should be carried out |
| cfg_diag | This indicates if diagnostics should be carried out |
| index_diag | This indicates the element of the time_diag signal to be used for diagnostics |
| expected_diag | This indicates the value expected from the diagnostic check |

TABLE 10-continued

| Register Type | Description |
|---|---|
| cfg_diag_sec | This indicates if diagnostics should be carried out in security condition |
| index_diag_sec | This indicates the element of the time_diag signal to be used for diagnostics in security condition |
| expected_diag_sec | This indicates the value expected from the diagnostic check in security condition |

TABLE 11

| CONFIGURATION DATA FOR THE INJECTION PROFILES TO BE ACTUATED IN NORMAL CONDITIONS | |
|---|---|
| time_prof | Table containing the instants of variation of the injection profile |
| profile | Table containing the configuration values of signals curr_out and pwm_out for every instant of variation of the injection profile |
| cfg_time_prof | This indicates whether the actuation of the injection profile should be based on time or angles |
| cam_phase_conf | This indicates the phase in which injection should be carried out |
| num_shape | Number of shapes forming the injection profile |

TABLE 12

| CONFIGURATION DATA FOR THE INJECTION PROFILES TO BE ACTUATED IN SECURITY CONDITION | |
|---|---|
| time_prof_sec | Table similar to time_prof but valid in security condition |
| profile_sec | Table similar to profile but valid in security condition |
| cfg_time_prof_sec | This indicates whether the actuation of the injection profile in security condition should be based on time or angles |
| cam_phase_conf_sec | This indicates the phase in which injection should be carried out in security condition |
| num_shape_sec | Number of shapes forming the injection profile in security condition. |

TABLE 13

| | |
|---|---|
| Output to "pend_inj" | |
| Mask | Interrupt mask |
| Input from "inj" | |
| stato_out | This allows tracing the "inj" state |
| cfg_pwm | This indicates the current configuration of module "pwm_inj" |
| curr_out | This indicates the current configuration of the steady driver driving signals |
| Input from "pend_inj" | |
| pending | This indicates the type of error occurred |

The operation of module 29 "inj" shall now be described in deeper detail.

Figure 4D:
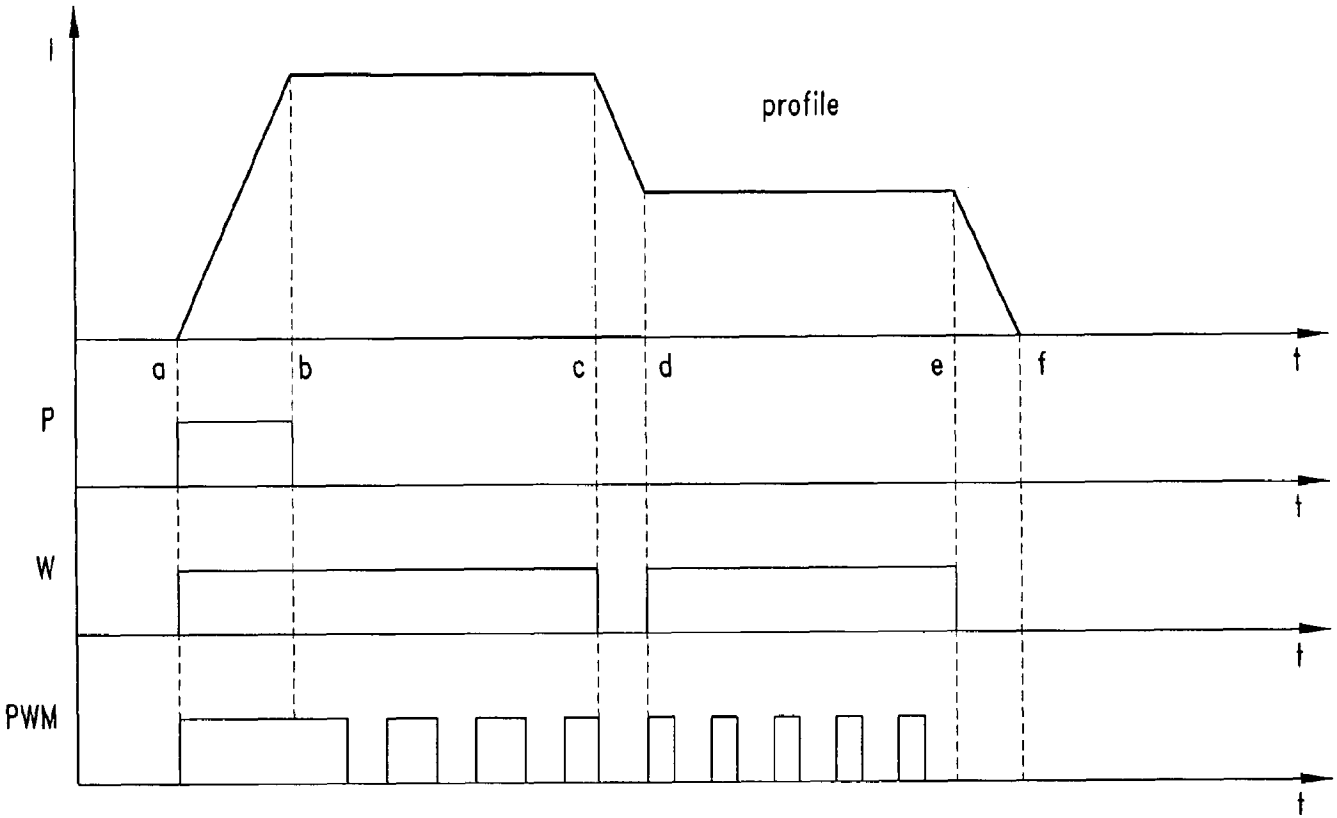
FIG. 4D shows a diagram having the same time basis with a set of profiles corresponding to injection piloting signals for the system of the present invention.

The task of such module 29 consists of actuating the injection process according to the stored profile, which indicates both the time the injection should start and the quantity of fuel to be injected during the process. An example of injection profile to be actuated, intended as current profile to be applied to the injector is shown in FIG. 4D.

Figure 5D:
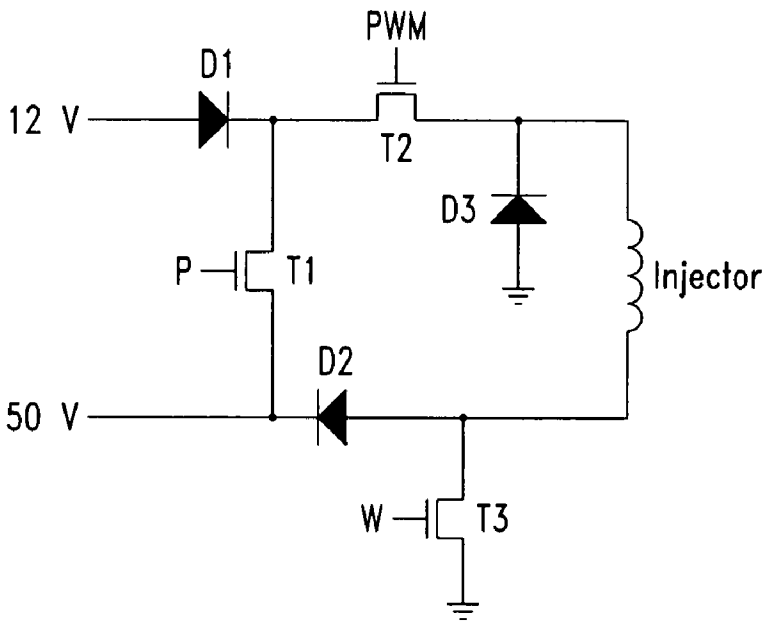
FIG. 5D shows a wiring diagram of an injector driving circuit.

On the other hand, an example of circuit used to generate the desired current profile is shown in FIG. 5D. This type of electronic circuits, known as power drivers, can be driven by system 6 of the present invention.

The circuit of FIG. 5D substantially is a bridge circuit wherein the current flow fed toward the injector is regulated by a first power transistor T1, driven by a signal P, and by a second transistor T2, driven by a PWM signal.

A third transistor T3, driven by a signal W, allows to close the current path toward earth, when needed.

In fact, signals P, applied to the gate of transistor T1, W, applied to the gate of transistor T3, and PWM, applied to the gate of transistor T2, allow to adapt the current driving of a wide variety of drivers for car injectors in a very flexible manner.

Figure 3D:
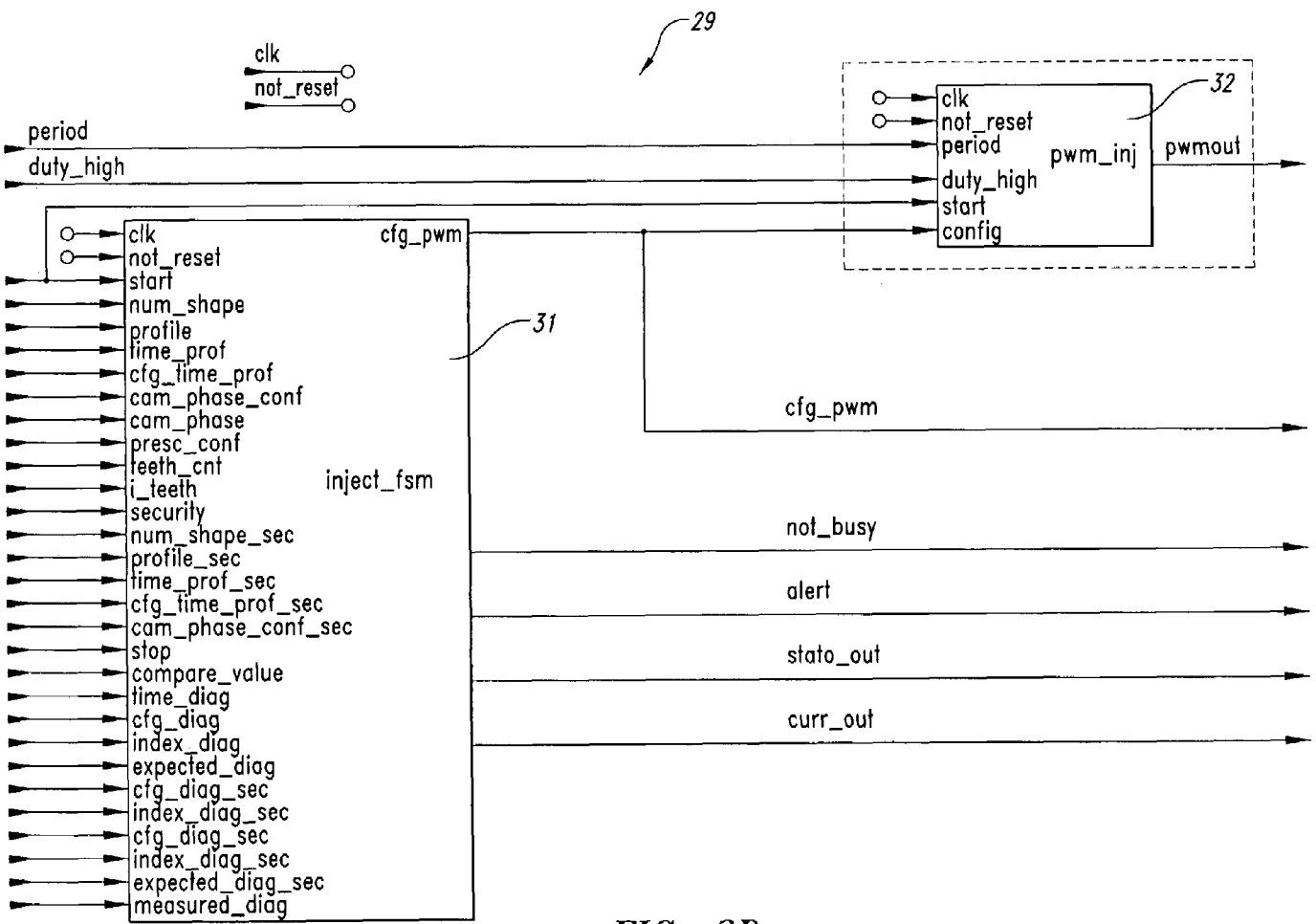
FIG. 3D shows a schematic view of a detail of the architecture of FIG. 2D.

Moreover, this object is achieved by the architecture of FIG. 3D, showing the internal structure of module 29 "inj", comprising a main block 31 indicated with the abbreviation "inject_fsm", and an auxiliary block 32 "pwm_inj", whose purpose is that of generating the desired PWM signals through configuration commands provided by the main block 31 "inject_fsm".

The operation of block 32 "pwm_inj" shall now be described in deeper detail.

Figure 6B:
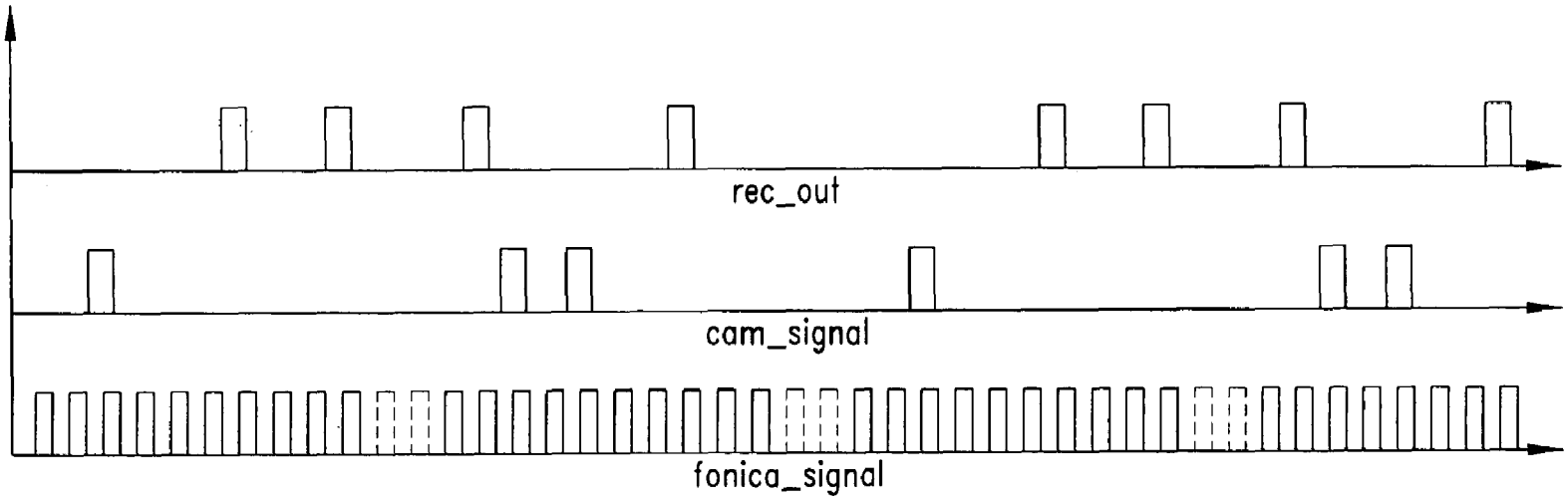
Figure 6D:
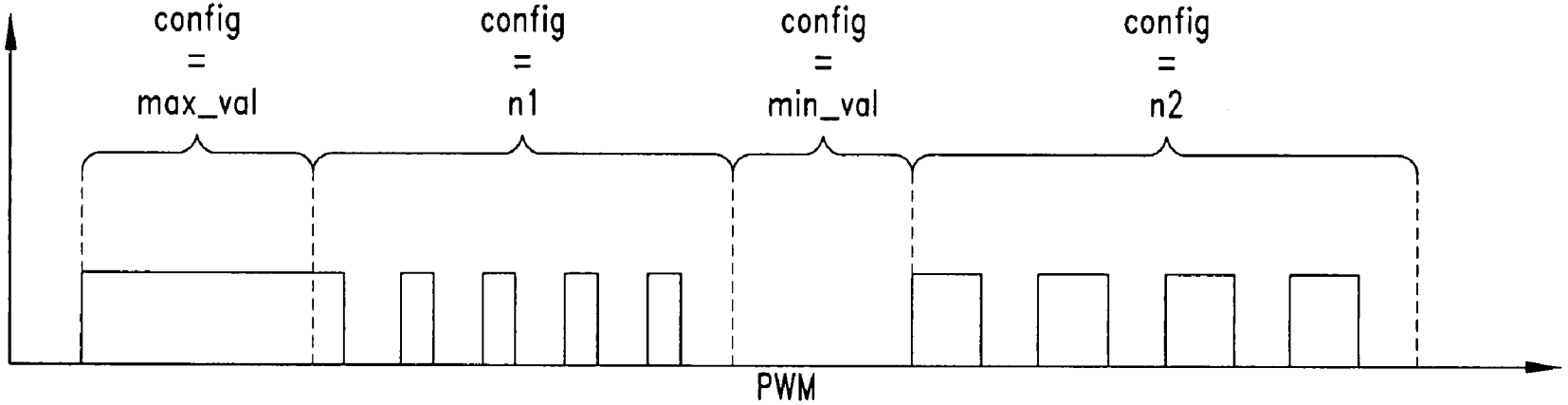
FIG. 6D shows a diagram with the time-based evolution of a PWM signal generated through the system of the present invention.
Figure 7D:
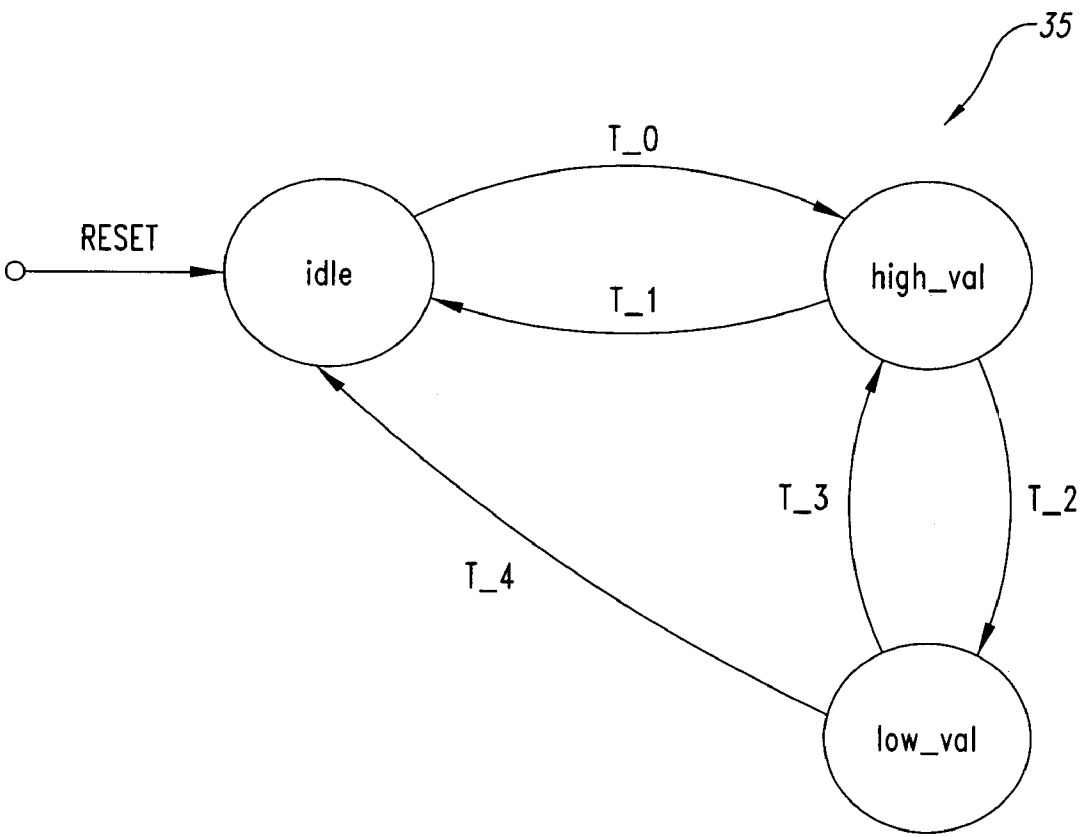
FIG. 7D shows a further schematic view of a state machine that illustrates the operation of a subsystem of the driving system (indicated with reference numeral 8 in FIG. 3D).

The task of such block 32 is that of generating a square wave with desired duty-cycle, for example like the one shown in FIG. 6D, with the possibility of obtaining both a high logical value and a low logical value in output.

The input signals of block 32 "pwm_inj" are as follows:

clk,
not_reset,
start,
period,
duty_high,
config.

The output signal is pwmout. The behavior of module 30 can be described with a state machine 35 like that shown in FIG. 7D.

The configuration parameters that allow to have the desired signal are given by signals period, duty_high and config.

The signals period and duty_high respectively indicate the period and the duty-cycle of the signal that must be generated.

The signal config allows to select whether the signal to generate should be PWM or a steady signal at the logical value 0 or 1.

The signal duty_high, on the other hand, is a table wherein the elements contain a predetermined series of duty-cycle values programmable by the user.

The signal config is used as index of the table indicated by duty_high to select the desired duty-cycle value; it can take two further values, which respectively indicate whether the signal pwmout must be a steady signal at the logical level 0 (config=min_val) or at the logical level 1 (config=max_val).

Upon start-up, or after resetting system 6, the state machine 35 is in its initial status, indicated in the figure by "idle".

If the signal config takes either the value min_val or the value max_val, the state machine 35 remains in the "idle" status and the signal pwmout is forced at the logical value 0 or 1.

On the other hand, if config takes a value comprised between min_val and max_val, by activating the signal start, the state machine 35 passes through the state "high_val" (transition T_0). In this status, the signal pwmout is forced at the logical level 1, a counter/timer is started and checked to see that it reaches the value indicated by the element duty_high(config); when this condition occurs, the state machine 35 passes through the state "low_val" (transition T_2), the signal pwmout is forced at the logical level 0 and the timer is checked to see that it reaches the value indicated by the signal period.

When this condition occurs, the timer/counter is reset and the state machine 35 passes through the state "high_val" (transition T_3) so as to continue generating the desired signal. From the states "high_val" and "low_val" it is possible to stop the operation of the state machine and bring it back to the idle status by disabling the signal start (transitions T_1 and T_4).

Figure 8D:
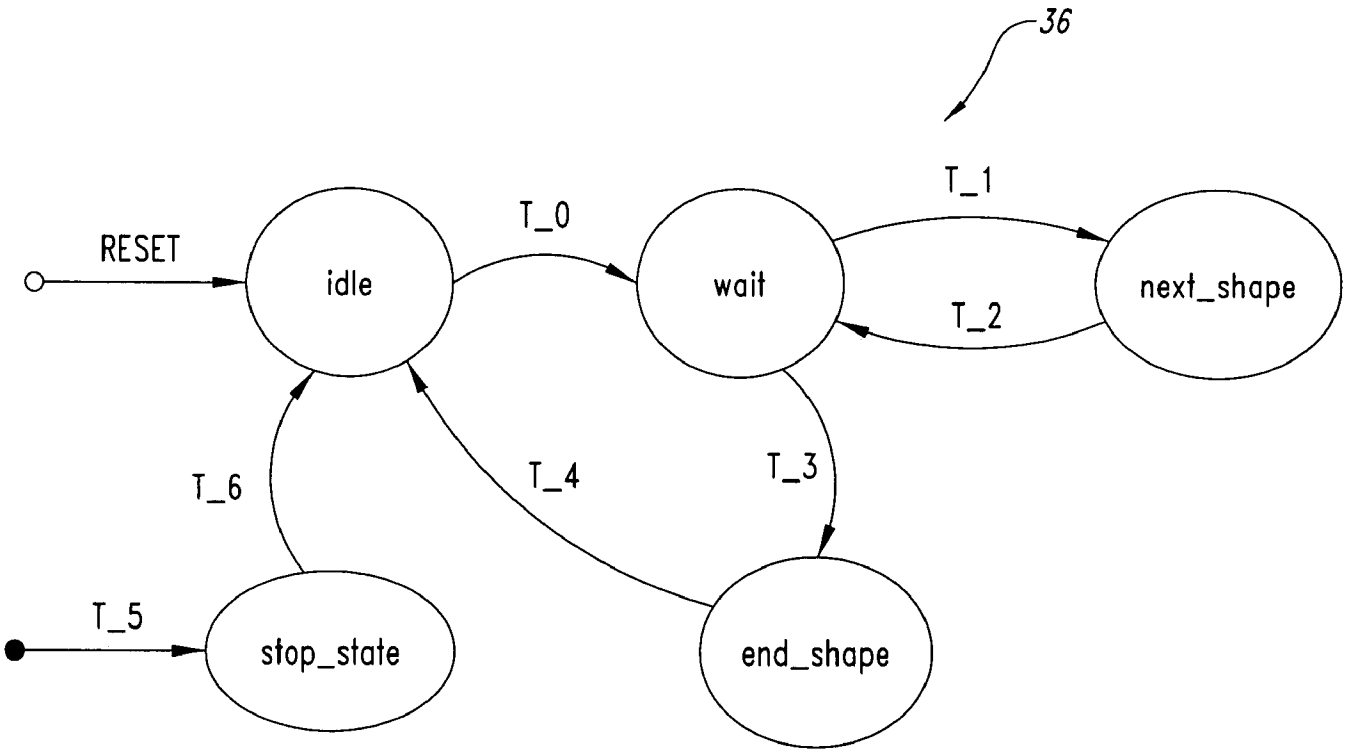
FIG. 8D shows a schematic view of a state machine that illustrates the operation of the driving system according to the invention (indicated with reference numeral 7 in FIG. 3D)

The behavior of block 31 "inject_fsm" embedded in module 29 is described through a state machine 36 shown in FIG. 8D.

Block 31 "inject_fsm" can work in two modes, according to the status of signal security. These two modes are identical as regards the execution, but they use two different data sets; if the security mode is disabled, the set of data taken into consideration is that of Table 10; on the other hand, if the security mode is enabled, the set of data taken into consideration is that of Table 11.

The behavior of the state machine 36 is described in this way with reference to the normal working condition only, and considering the injection profile shown in FIG. 4D.

The initial status of the state machine 36 is, also in this case, called "idle", a status that is reached upon start-up and/or after resetting system 6.

By activating the signal start, the state machine 36 passes through the status "stand-by" (transition T_0), wherein the configuration of outputs curr_out and pwm_out is given by the first element of the table profile and it remains in such status until the value of the first element of table time_prof matches either the value of the internal timer, if the injection must occur on a time basis, or the values indicated by the signals teeth_cnt and i_teeth, if the injection must occur on an angle basis.

This event coincides with the point a of the injection profile shown in FIG. 4D. When this event occurs, the state machine passes through the state "shap_succ" (transition T1), where the next elements of tables profile and time_prof are selected, to return to the "stand-by" status again (transition T_2) and remain there until the event indicated with b in FIG. 4D occurs.

The transitions between the "stand-by" status and the "shape_succ" status follow one another up to considering the last elements of tables profile and time_prof (event indicated with e in FIG. 4D).

At this point, the state machine passes through the status "fine_shape" (transition T_3), where an interrupt is generated to indicate that the injection process has been completed and the system is waiting for the signal start to be disabled so as to bring the state machine back to its "idle" status (transition T_4), where the next injection is expected.

Block 31 "inject_fsm" of module 29 allows to carry out a diagnostic process during the injection process, and this allows to check if this is being executed properly.

The register cfg_diag contains a flag for every element of the table time_prof that indicates, if it is active, that the diagnostics should be carried out after the event indicated by the current element of time_prof.

If a flag is active, the corresponding element of table index_diag indicates an element of the table time_diag that represents the time that must be waited for from the occurrence of the event indicated by the table time_prof before comparing the diagnostic signal measured_diag, transmitted by the injector drive, with the signal expected_diag, which indicates the expected value in case of correct operation. An interrupt is then generated if the value of expected_diag differs from that of measured_diag.

It is also possible to activate an internal timer-watchdog to report any problems in case nothing occurs for a fixed time interval and when in the states of "stand-by" and "shape_succ"; the signal overflow indicates the maximum limit to be reached by the internal timer-watchdog to report this type of problem.

The task of the auxiliary block 30 "pend_inj" associated to the main block 31 "inject_fsm" embedded in module 29 consists of generating an interrupt signal toward the ECU controller.

Such block 30 receives an input signal from module 29 "inj" indicating the type of error occurred, and it generates a signal for module 28 "dec_injection" to set properly the "pending" register, whose reading allows the controller to determine the type of error so as to decide the action to be taken.

Thanks to the features described above, the driving injection manager 6 can also be applied to a variety of engines, each provided with different injector driving drivers.

The piloting system 6 can be adapted to the wide variety of types of injection profiles for car injector drivers used in the automotive field, this thanks to the wide configurability of the parameters allowed by modules 28, 29 and 30. This makes the system according to the invention very flexible and reusable in several applications.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. An architecture of an ignition management system for an internal combustion engine, adapted to cooperate with an electronic engine control unit, the architecture comprising:

a first module structured to process electric signals from which an angular position of an engine drive shaft can be obtained;

a second module structured to process electric signals from which a cycle phase of the engine can be obtained;

a third module structured to supply suitable signals for driving injectors so as to actuate a desired injection profile stored inside the third module, in a manner that injections during a same operating phase of the engine are increased and are based at least in part on said angular position of the drive shaft; and a fourth module structured to receive signals from the first and second modules and from the fourth module itself, wherein the first module receives an input signal from a sensor of a phonic wheel made rotatively rigid with respect to the engine drive shaft, and wherein the phonic wheel has a number of equidistant teeth arranged on a circumference, a small group of adjoining teeth being missing to define a reference point on the wheel detectable by the sensor.

2. The architecture according to claim 1 wherein the second module receives an input signal from a sensor of a phonic wheel made rotatively rigid with respect to an engine camshaft.

3. The architecture according to claim 1 wherein the third module receives a pair of input signals from the second module, said signal pair relating to the engine cycle phase and to said number of teeth of said phonic wheel, and furthermore the third module takes an additional input signal from the first module, the additional signal relating to the angular position of the engine drive shaft.

4. The architecture according to claim 1 wherein the fourth enabling module receives a first input signal relating to the angular position of the engine drive shaft, a second signal relating to the cycle phase of the engine, and a third signal indicating the operational state of the third module.

5. The architecture according to claim 1 wherein the number of teeth of the phonic wheel and a number of said missing teeth are programmable.

6. The architecture according to claim 1 wherein the first, second and third modules are structurally and functionally independent.

7. The architecture according to claim 2 wherein the second module receives an input signal of a teeth counter of said drive shaft phonic wheel from the first module, and wherein an amount of phase displacement may be provided between said signal and the signal from the sensor associated with the camshaft in order to control a cycle phase of variable timing engines.

8. The architecture according to claim 1 wherein the fourth module is a logic network.

9. The architecture according to claim 2 wherein the phonic wheel of said engine camshaft has a configurable arrangement of teeth along its circumference.

10. The architecture according to claim 2 wherein the second module may be programmed so as to be adapted to different camshaft phonic wheels.

11. The architecture according to claim 9 wherein the second module may be programmed so as to be adapted to different camshaft phonic wheels.

12. An electronic device for determining an operating phase of an internal combustion motor, the device being of a type structured to cooperate with an electronic motor control unit and receiving an input signal issued from a sensor of a phonic wheel associated with the motor camshaft, the device comprising:

a first I/O interface module incorporating a plurality of registers and receiving signals from the electronic motor control unit;

a second module connected bi-directionally to the first module and receiving the input signal issued from said sensor to identify a camshaft reference and to supply an operating phase of the motor; and a third module adapted to issue an interrupt signal to the electronic engine control unit according to an error signal incoming from the second module, wherein injections during a same operating phase of the motor are increased and are based at least in part on an angular position of a drive shaft.

13. The device according to claim 12 wherein the registers of the first module can be accessed both while reading and writing from the electronic engine control unit via a standard interface.

14. The device according to claim 12 wherein a search for the reference and a following calculation of a camshaft position are carried out in the second module by continually monitoring the signal from the sensor of the camshaft phonic wheel.

15. The device according to claim 12 wherein a second set of registers, inside the first module, contain data about an internal state and results of the second module.

16. The device according to claim 12 wherein once an interrupt signal is generated, a relevant internal register of the first module is also updated, from which a type of error caused by the second module can be found.

17. The device according to claim 12 wherein the registers included in the first module include:

| | |
|---|---|
| start | Starts the state machine implemented in "cams_shaft" |
| Stop | Stops the state machine implemented in "cams_shaft" and brings it back to its initial state ready to start again. |
| mem_cam_changes1 | Table of size1 items, containing the number-of-tooth values of the drive shaft phonic wheel where transitions occur on the cam signal during the drive shaft rotation corresponding to phase zero. |
| profile1 | Indicates the expected value of the cam profile stored in mem_cam_changes1. |
| size1 | Indicates the number of items stored in the mem_cam_changes1 and profile1 tables. |
| mem_cam_changes2 | Table of size1 items, containing the number-of-tooth values of the drive shaft phonic wheel where transitions occur on the cam signal during the drive shaft rotation corresponding to phase one. |
| profile2 | Indicates the expected value of the cam profile stored in mem_cam_changes2. |
| size2 | Indicates the number of items stored in the mem_cam_changes2 and profile2 tables. |
| mem_cam_r | Table of sizer items, containing the number-of-tooth values of the drive shaft phonic wheel where transitions occur for the reconstructed cam signal. |
| Profiler | Indicates the expected value of the cam profile stored in mem_cam_r. |
| Sizer | Indicates the number of items stored in the mem_cam_r and profiler1 tables. |
| Delta | Indicates the width of the interval around the time point when the system is expecting a tooth of the camshaft phonic wheel. |
| offset_out | Indicates the extent that the cam signal has to be shifted from the drive shaft phonic wheel signal. |
| a_ns | Indicates whether the shift has to occur in the forward or the backward direction. |
| cfg_phase | Indicates if the teeth counter of the drive shaft phonic wheel has to be shifted. |
| error_at | Indicates the number of the tooth where the last error occurred. |
| teeth_cnt | Indicates the drive shaft angular position as phonic wheel teeth counter from 1 to 2* (n_tooth_holes). |
| cam_phase | Indicates the motor phase. |
| lock_cam | Indicates that the motor operating phase is found. |
| stato_out | Indicates the current state of the "cams_shaft" state machine. |
| rec_out | Desired camshaft profile. |

18. The device according to claim 17 wherein the second set of registers of the first module is updated by the second module include:

| | |
|---|---|
| error_at | Indicates the number of the tooth where the last error occurred. |
| teeth_cnt | Indicates the drive shaft angular position as phonic wheel teeth counter from 1 to 2* (n_tooth_holes). |

-continued

| | |
|---|---|
| cam_phase | Indicates the motor phase. |
| lock_cam | Indicates that the motor operating phase is found. |
| stato_out | Indicates the current state of the "cams_shaft" state machine. |
| rec_out | Desired camshaft profile. |

19. The device according to claim 12 wherein the second module constantly checks pulses of the signal from the sensor, and it evolves according to a state machine on a basis of a table correlating a profile of a drive shaft phonic wheel with the camshaft phonic wheel.

20. The device according to claim 19 wherein a format of the correlation table is the following:

| Phase 0 | | Phase 1 | |
|---|---|---|---|
| mem_cam_changes1 | profile1 | mem-cam_changes2 | Profile2 |
| 2 | 1 | 14 | 1 |
| 3 | 0 | 15 | 0 |
| | | 16 | 1 |
| | | 17 | 0 |

and includes a first table for Phase 0, containing transitions of the signal during a first rotation of the drive shaft, and a table for Phase 1 containing transitions of the signal during a second rotation of the drive shaft.

21. An architecture of an electronic device for determining the angular position of a drive shaft in internal combustion engines, the architecture being of the type intended to cooperate with an engine's electronic control unit and receiving an input signal emitted by a sensor of a tone wheel associated with the drive shaft, the architecture comprising:

a first I/O interface module embedding a plurality of registers and receiving signals from the electronic control unit of the engine;

a second module bi-directionally connected to the first module and receiving the input signal emitted by the sensor to detect a reference on the drive shaft and provide its angular position moment by moment; and a third module capable of emitting an interrupt signal to the electronic engine control unit on the basis of an error signal received from the second module, wherein injections during a same operating phase of the engine are increased and are based at least in part on the angular position of a drive shaft.

22. The architecture according to claim 21 wherein the registers of the first module can be accessed in reading and writing mode by the electronic engine control unit via a standard interface.

23. The architecture according to claim 21 wherein in the second module a search of the reference and a subsequent calculation of the drive shaft position occur by constantly monitoring the signal transmitted by the sensor of the tone wheel.

24. The architecture according to claim 21 wherein a second set of registers internal to the first module contains data relating to an internal status and results of the second module.

25. The architecture according to claim 21 wherein a generation of an interrupt signal also updates a related register internal to the first module from which it is possible to trace a type of error generated by the second module.

26. The architecture according to claim 21 wherein the registers embedded in the first module include:

| | |
|---|---|
| start | Starts the state machine implemented in "fsm_fonica". |
| Stop | Stops the state machine implemented in "fsm_fonica" restoring its original status waiting for a new start-up. |
| Overflow | Sets the waiting time limit so that the lack of teeth in this time interval indicates a system error status. |
| num_of_teeth | This indicates the tone wheel number of teeth. |
| num_of_holes | This indicates the tone wheel number of holes. |
| num_of_check | This indicates the number of revolutions of the drive shaft to be waited after the lock before passing to the injection phase. |
| Delta | This indicates the extent of the interval around the time instant in which the system expects a tone wheel tooth. |
| cfg_filter | Enables or disables the digital filter to be applied on the signal transmitted by the tone wheel. |
| cfg_check | This indicates whether it is necessary to reset, in case of error, the count of already executed checks. |
| error_at | This indicates the number of tooth where the last error occurred. |
| Tooth_num | This indicates the current number of tooth of the tone wheel. |
| i_teeth | This indicates an intermediate position between two adjacent teeth of the same tone wheel with a fixed accuracy. |
| Frt | Free running timer. |
| Stato_out | This indicates the current status of the state machine of the "fsm_fonica". |
| Diffdente_out | This indicates a value from which it is possible to trace the revolution speed of the drive shaft with the following expression: $rmp = \frac{f * 60}{n_tooth_holes * diffdente_out}$ where f is the system clock frequency (clk). |
| Pending | This indicates the type of error occurred. |

27. The architecture according to claim 23 wherein the second module checks that every subsequent pulse of the signal occurs within a fixed temporal window or that no pulse is received within said window to pass through the tone wheel point of reference search status.

28. The architecture according to claim 27 wherein the temporal window is determined as a difference between subsequent instants of reception of the signal, also determining a center of an interval in which the next pulse is expected; an extent of the interval being calculated as ratio based at least in part on a number of teeth of the tone wheel.

29. An architecture of a system for driving an injection and/or ignition in internal combustion engines, of a type intended to cooperate with an engine electronic control unit by driving corresponding injection drivers, and comprising:

a first I/O interface module embedding a plurality of registers and receiving signals from the engine electronic control unit (ECU);

a second module bi-directionally connected to the first module from which it receives information at least on injection times and a quantity of fuel to be injected for generating driving signals for the injection drivers, thereby actuating a desired injection profile, in a manner that injections during a same operating phase of the engine are increased and are based at least in part on the angular position of a drive shaft of the engine; and a third module capable of emitting an interrupt signal to the electronic engine control unit on a basis of signals received by the second module.

30. The architecture according to claim 29 wherein the registers of the first module can be accessed in writing and reading mode from the ECU by a standard interface.

31. The architecture according to claim 29 wherein the registers embedded in the first module include:

| | |
|---|---|
| start | Its status is reported by the output "start_dec" |
| Stop | Stops the state machine implemented in "inj" restoring its original status waiting for a new start. |
| presc_conf | Prescaler of the timer internal to module "inj" |
| Period | Period of the PWM signals to be generated |
| duty_high | Table containing a set of duty-cycle values of the PWM signals to be generated |
| Security | This indicates if the security condition is enabled |
| compare_value | Watchdog value |
| time_diag | This indicates the instants in which diagnostics should be carried out |
| cfg_diag | This indicates if diagnostics should be carried out |
| Index_diag | This indicates the element of the time_diag signal to be used for diagnostics |
| expected_diag | This indicates the value expected from the diagnostic check |
| cfg_diag_sec | This indicates whether diagnostics should be carried out in security condition |
| Index_diag_sec | This indicates the element of the time_diag signal to be used for diagnostics in security condition |
| expected_diag_sec | This indicates the value expected from the diagnostic check in security condition |
| time_prof | Table containing the instants of variation of the injection profile |
| Profile | Table containing the configuration values of signals curr_out and pwm_out for every instant of variation of the injection profile |
| cfg_time_prof | This indicates whether the actuation of the injection profile should be based on time or angles |
| cam_phase_conf | This indicates the phase in which injection should be carried out |
| num_shape | Number of shapes forming the injection profile |
| time_prof_sec | Table similar to time_prof but valid in security condition |
| profile_sec | Table similar to profile but valid in security condition |
| cfg_time_prof_sec | This indicates whether the actuation of the injection profile in security condition should be based on time or angles |
| cam_phase_conf_sec | This indicates the phase in which injection should be carried out in security condition |
| num_shape_sec | Number of shapes forming the injection profile in security condition |
| Output to "pend_inj" | |
| Mask | Interrupt mask |
| Input from "inj" | |
| stato_out | This allows to trace the "inj" state |
| cfg_pwm | This indicates the current configuration of module "pwm_inj" |
| curr_out | This indicates the current configuration of the steady driver driving signals |
| Input from "pend_inj" | |
| Pending | This indicates the type of error occurred. |

32. The architecture according to claim 29 wherein the second module directly receives an input signal relating to an engine phase, and a further pair of signals related to an angular position of a drive shaft.

33. The architecture according to claim 29 wherein when an interrupt signal is generated a relevant internal register of the first module is also updated from which it is possible to trace the type of error generated by the second module.

34. The architecture according to claim 29 wherein the second module comprises a main block for driving the injection drivers and an auxiliary block adapted for generating PWM signals through configuration commands provided by the main block.

35. The architecture according to claim 34 wherein the auxiliary block is in charge of generating both a square wave with a desired duty-cycle and of obtaining either a high or a low logical value in output.

36. The architecture according to claim 35 wherein the main block operates in two modes by using a corresponding set of data in the registers; one of said modes being a security mode for which a set of data taken into consideration includes:

| | |
|---|---|
| time_prof_sec | Table similar to time_prof but valid in security condition |
| profile_sec | Table similar to profile but valid in security condition |
| cfg_time_prof_sec | This indicates whether the actuation of the injection profile in security condition should be based on time or angles |
| cam_phase_conf_sec | This indicates the phase in which injection should be carried out in security condition |
| num_shape_sec | Number of shapes forming the injection profile in security condition. |

* * * * *

UNITED STATES PATENT AND TRADEMARK OFFICE

CERTIFICATE OF CORRECTION

PATENT NO. : 7,310,574 B2
APPLICATION NO. : 10/722375
DATED : December 18, 2007
INVENTOR(S) : Eusebio Di Cola et al.

It is certified that error appears in the above-identified patent and that said Letters Patent is hereby corrected as shown below:

Column 25
Lines 15-56,
“ ”

| | |
|---|---|
| start | Starts the state machine implemented in "cams_shaft" |
| Stop | Stops the state machine implemented in "cams_shaft" and brings it back to its initial state ready to start again. |
| mem_cam_changes1 | Table of *size1* items, containing the number-of-tooth values of the drive shaft phonic wheel where transitions occur on the cam signal during the drive shaft rotation corresponding to phase zero. |
| profile1 | Indicates the expected value of the cam profile stored in *mem_cam_changes1*. |
| size1 | Indicates the number of items stored in the *mem_cam_changes1* and *profile1* tables. |
| mem_cam_changes2 | Table of *size1* items, containing the number-of-tooth values of the drive shaft phonic wheel where transitions occur on the cam signal during the drive shaft rotation corresponding to phase one. |
| profile2 | Indicates the expected value of the cam profile stored in *mem_cam_changes2*. |
| size2 | Indicates the number of items stored in the *mem_cam_changes2* and *profile2* tables. |
| mem_cam_r | Table of *sizer* items, containing the number-of-tooth values of the drive shaft phonic wheel where transitions occur for the reconstructed cam signal. |
| Profiler | Indicates the expected value of the cam profile stored in *mem_cam_r*. |
| Sizer | Indicates the number of items stored in the *mem_cam_r* and *profiler1* tables. |
| Delta | Indicates the width of the interval around the time point when the system is expecting a tooth of the camshaft phonic wheel. |
| offset_out | Indicates the extent that the cam signal has to be shifted from the drive shaft phonic wheel signal. |
| a_ns | Indicates whether the shift has to occur in the forward or the backward direction. |
| cfg_phase | Indicates if the teeth counter of the drive shaft phonic wheel has to be shifted. |
| error_at | Indicates the number of the tooth where the last error occurred. |
| teeth_cnt | Indicates the drive shaft angular position as phonic wheel teeth counter from 1 to 2* (n_tooth_holes). |
| cam_phase | Indicates the motor phase. |
| lock_cam | Indicates that the motor operating phase is found. |
| stato_out | Indicates the current state of the "cams_shaft" state machine. |
| rec_out | Desired camshaft profile. |

UNITED STATES PATENT AND TRADEMARK OFFICE

CERTIFICATE OF CORRECTION

PATENT NO. : 7,310,574 B2
APPLICATION NO. : 10/722375
DATED : December 18, 2007
INVENTOR(S) : Eusebio Di Cola et al.

It is certified that error appears in the above-identified patent and that said Letters Patent is hereby corrected as shown below:

should read as

--

| | |
|---|---|
| start | Starts the state machine implemented in "cams_shaft" |
| Stop | Stops the state machine implemented in "cams_shaft" and brings it back to its initial state ready to start again. |
| mem_cam_changes1 | Table of *size1* items, containing the number-of-tooth values of the drive shaft phonic wheel where transitions occur on the cam signal during the drive shaft rotation corresponding to phase zero. |
| profile1 | Indicates the expected value of the cam profile stored in *mem_cam_changes1*. |
| size1 | Indicates the number of items stored in the *mem_cam_changes1* and *profile1* tables. |
| mem_cam_changes2 | Table of *size1* items, containing the number-of-tooth values of the drive shaft phonic wheel where transitions occur on the cam signal during the drive shaft rotation corresponding to phase one. |
| profile2 | Indicates the expected value of the cam profile stored in *mem_cam_changes2*. |
| size2 | Indicates the number of items stored in the *mem_cam_changes2* and *profile2* tables. |
| mem_cam_r | Table of *sizer* items, containing the number-of-tooth values of the drive shaft phonic wheel where transitions occur for the reconstructed cam signal. |
| Profiler | Indicates the expected value of the cam profile stored in *mem_cam_r*. |
| Sizer | Indicates the number of items stored in the *mem_cam_r* and *profiler1* tables. |
| Delta | Indicates the width of the interval around the time point when the system is expecting a tooth of the camshaft phonic wheel. |
| offset_out | Indicates the extent that the cam signal has to be shifted from the drive shaft phonic wheel signal. |
| a_ns | Indicates whether the shift has to occur in the forward or the backward direction. |
| cfg_phase | Indicates if the teeth counter of the drive shaft phonic wheel has to be shifted. |

--

Signed and Sealed this

Sixteenth Day of June, 2009

John Doll

JOHN DOLL
*Acting Director of the United States Patent and Trademark Office*